US008777506B2

(12) United States Patent
Akaishi et al.

(10) Patent No.: US 8,777,506 B2
(45) Date of Patent: Jul. 15, 2014

(54) LIQUID APPLICATOR

(75) Inventors: Tetsuaki Akaishi, Fujioka (JP); Hiroaki Koyama, Fujioka (JP)

(73) Assignee: Mitsubishi Pencil Co., Ltd., Shinagawa-ku, Tokyo (JP)

( * ) Notice: Subject to any disclaimer, the term of this patent is extended or adjusted under 35 U.S.C. 154(b) by 840 days.

(21) Appl. No.: 12/084,708

(22) PCT Filed: Nov. 9, 2006

(86) PCT No.: PCT/JP2006/322371

§ 371 (c)(1),
(2), (4) Date: May 8, 2008

(87) PCT Pub. No.: WO2007/055277

PCT Pub. Date: May 18, 2007

(65) Prior Publication Data

US 2009/0283033 A1 Nov. 19, 2009

(30) Foreign Application Priority Data

Nov. 9, 2005 (JP) ..... 2005-324955
Nov. 30, 2005 (JP) ..... 2005-345593

(51) Int. Cl.
*B05C 11/00* (2006.01)

(52) U.S. Cl.
USPC ..... 401/266; 401/265; 401/263; 401/172

(58) Field of Classification Search
USPC ..... 401/171–173, 176, 177, 179–182, 265, 401/266, 221, 263; D28/7
See application file for complete search history.

(56) References Cited

U.S. PATENT DOCUMENTS 2,442,503 A * 6/1948 Melnikoff ..... 401/175
D213,481 S * 3/1969 Hubbell ..... D28/7

(Continued)

FOREIGN PATENT DOCUMENTS

JP 62-163769 A 7/1987
JP 63-185485 U 11/1988

(Continued)

OTHER PUBLICATIONS

Notification of Transmittal of Translation of the International Preliminary Report on Patentability (Form PCT/IB/338), Internatioanl Preliminary Report on Patentability (Form PCT/IB/373), Written Opinion of the International Search Authority (Form PCT/ISA/237) mailed in corresponding International Patent Application No. PCT/JP2006/322371, May 14, 2008, The International Bureau of WIPO, Geneva, CH.

(Continued)

*Primary Examiner* — David Walczak
*Assistant Examiner* — Bradley Oliver
(74) *Attorney, Agent, or Firm* — Buchanan Ingersoll & Rooney PC

(57) ABSTRACT

A liquid applicator includes a liquid pressing mechanism (liquid pressing means) for pressurizing an application liquid inside a main body so as to supply application liquid to an applying member by the pressing of the liquid pressing mechanism. The applying member is made of an elastic material and is formed with a communication path of a passage hole for communication between the inside and outside of main body, and an applying portion of the applying member is formed projected further forward from an ejection opening of communication path. The liquid applicator that can simply apply an application liquid, even it is high in viscosity, over a wide area.

28 Claims, 18 Drawing Sheets

(56) References Cited

U.S. PATENT DOCUMENTS

| | | | | |
|---|---|---|---|---|
| 5,002,415 | A | 3/1991 | Gueret | |
| 5,096,319 | A | 3/1992 | Gueret | |
| 5,890,630 | A * | 4/1999 | Lobdell | 401/266 |
| 6,464,115 | B2 * | 10/2002 | Wemyss et al. | 401/266 |
| 7,168,878 | B2 | 1/2007 | Tani | |
| 2003/0057236 | A1 * | 3/2003 | Delage | 401/172 |
| 2004/0042841 | A1 * | 3/2004 | Noguchi | 401/270 |
| 2005/0063768 | A1 | 3/2005 | Tani | |
| 2008/0286034 | A1 * | 11/2008 | Chu et al. | 401/266 |

FOREIGN PATENT DOCUMENTS

| | | | |
|---|---|---|---|
| JP | 2-104306 | A | 4/1990 |
| JP | 04-010814 | U | 1/1992 |
| JP | 05-063556 | U | 8/1993 |
| JP | 9-192581 | A | 7/1997 |
| JP | 9-322819 | A | 12/1997 |
| JP | 2603088 | Y2 | 12/1999 |
| JP | 3081834 | B2 | 6/2000 |
| JP | 3109917 | U | 6/2000 |
| JP | 2002-34648 | A | 2/2002 |
| JP | 2002-68332 | A | 3/2002 |
| JP | 2003-136894 | A | 5/2003 |
| JP | 2003-252387 | A | 9/2003 |
| JP | 2003-325226 | A | 11/2003 |
| JP | 2004-89592 | A | 3/2004 |
| JP | 2004-313539 | A | 11/2004 |
| JP | 2005-66052 | A | 3/2005 |
| JP | 2005-87562 | A | 4/2005 |
| JP | 2005-118409 | A | 5/2005 |
| JP | 3109917 | U | 6/2005 |

OTHER PUBLICATIONS

International Search Report (PCT/ISA/210).

* cited by examiner

Inner sleeve member in section

Inner sleeve member in perspective

Inner sleeve member in section

Inner sleeve member in perspective

LIQUID APPLICATOR

TECHNICAL FIELD

The present invention relates to a liquid applicator or a liquid applicator having an applying member at the front end of a cylindrical main body that is constructed such that an application liquid is fed to the applying member at the front by pressurizing the application liquid stored in a storing space inside the main body by means of a liquid pressurizing/depressurizing mechanism and is drawn in by depressurizing, in particular, relating to a liquid applicator for applying an application liquid to a soft applied object such as skin, oral cavity etc.

BACKGROUND ART

Conventionally, there have been liquid applicators having a liquid pressing mechanism or liquid pressing means for pressurizing the application liquid inside the main body in order to supply the applying part with the application liquid in a timely manner.

For example, there is a proposal (see Patent document 1) of a liquid applicator that includes: an applying member attached at the front end of its barrel cylinder; a tank arranged inside the barrel cylinder for reserving a liquid in the rear of the applying member; a conduit hole portion for leading the liquid ejected from the tank to the applying member; and a liquid pushing means (liquid pressing mechanism) for pushing out the liquid inside the aforementioned tank to the applying member through the conduit hole portion by advancing a piston that is fitted in the tank so as to be slidable in its axial direction.

Also there is a proposal (see Patent document 2) for a liquid container including a main body having a tank portion holding a liquid therein; a feed mechanism having a front-end feeder joined at the front end of the main body for feeding the liquid; and an actuating mechanism for pushing the liquid inside the tank portion toward the feed mechanism.

Since in the liquid applicators as above, their brush-like applying member after usage holds a considerable amount of application liquid therein and is exposed to the outside air, there is the problem that the application liquid contained in the applying member degrades with time and is liable to be spoilt.

There is also a known configuration of a liquid applicator or liquid container having a mechanism for preventing against degradation of the application liquid with the passage of time or entrance of the outside air by using an elastic body for its applying part.

For example, there is a proposal of an application container which includes: an application container body for storing an application liquid therein; and an applying member disposed at the front end of the application container body, for applying the application liquid over an applied object and is used to apply the application liquid to the soft applied object by bringing the front end of the applying member into contact with the applied object, wherein the applying member is made of an approximately tubular elastic body with its front and rear ends open all the time and leads the application liquid in the application container body and ejects it from the front-end opening (e.g., see Patent document 3).

However, these liquid applicators are suitable for dribbling the application liquid but have the problem that it is difficult to apply the application liquid over a wide area in a simple manner. Also, there is another problem that they present difficulties when used in combination with a high viscosity application liquid because of structural reasons of their containers.

As described above, conventionally there have been liquid applicators for applying application liquids such as cosmetics, medial fluid and the like, which store an application liquid inside the main body and includes a liquid pressurizing mechanism or liquid pressing means provided with a piston and its advancing mechanism for pressurizing the application liquid inside the liquid storing chamber provided inside the main body in order to timely feed the application liquid to the applying member (applying part) arranged at the front end (see Japanese Patent No. 3081834: patent document 4, Japanese Utility Model Registration No. 2603088: patent document 5, and the like).

With such liquid applicators, drawing back the liquid that has been ejected to the applying part was previously considered to be problematic because the liquid that has come into contact with unwanted bacteria attached to skin and the like may be returned into the container.

Recently, however, owing to improvement in liquid's antibacterial power, this problem has become less important while there has been an increased demand for a liquid-restoring function to deal with the cases where the liquid has been excessively delivered, such as when the liquid happened to be ejected after a time lag when it was ejected by the piston, when the liquid expanded due to change in temperature, when the user made a pushing action more than needed and other cases.

Also, with a configuration where a fixed amount of liquid is ejected by pushing a piston while feeling a clicking sensation as in the cases of patent document 4 and patent document 5, no problem occurs when the advancing mechanism is operated in the direction of ejection. However, when the piston is retracted, there is a fear that unexpected deformation, breakdown and other damage of the mechanism occur as a result of application of a load more than required to a piston or shaft-shaped member.

FIG. 1 shows a piston body a that moves forwards and rearwards inside a conventional main body (inside a liquid storing chamber) and a front end part b1 of a shaft-shaped member b that engages boss a1 of the piston body, as is shown in patent document 4.

As sectionally shown in FIG. 1(*a*), cylindrical boss a1 having a space a2 opening rearwards, is extended at the rear side of piston body a. Formed in the inner wall of boss a1 that defines this space a2 is an annular rib c that is formed around the circumference and projected towards the center of the axis.

On the other hand, shaft-shaped member b is formed of a main body formed with a threaded portion b2 having a helical groove on its surface and a front end part b1 having an extended approximately cylindrical shape with no helical groove with a large-diametric flange portion d formed at its front end.

As shown in FIG. 1(*b*), front end part b1 of shaft-shaped member b is inserted into space a2 of the aforementioned boss a1 and further press-fitted thereinto, so as to make flange portion d climb over the aforementioned annular rib c, whereby front end part b1 of shaft-shaped member b is tightly fitted into space a2.

Conventionally, when piston body a is advanced, boss a1 in the rear part of piston body a is pushed forward by shaft-shaped member b, so that front end part b1 of shaft-shaped member b will not come off boss a1 of piston body a.

On the other hand, when piston body a is drawn back, the piston is pulled rearward by the engaging force of boss a1 in the rear part of piston body a with front end part b1 of shaft-shaped member b. This engaging force is brought about by flange portion d in the front end part b1 of shaft-shaped member b hooking annular rib c of boss a1, and mainly depends on the deformation-resisting force of boss a1.

When the application liquid is a high-viscosity fluid or a fluid whose viscosity has changed to be high due to environmental conditions such as temperature etc., there occurs a situation in which a strong force beyond the aforementioned engaging force needs to be applied to draw the piston body a.

In such a case, boss a1 becomes enlarged or deformed in any other way, so that annular rib c of boss a1 climbs over flange portion d of shaft-shaped member b, and shaft-shaped member b comes off boss a1, hence piston body a does not move, causing malfunction or unusability.

In contrast, if, in order to enhance the engaging force, the outside diameter of the aforementioned flange portion and the inside diameter of the annular rib are made greater so as to make the height of the step therebetween greater, not only the engaging force of the shaft-shaped member with the boss but also, the press-fitting force when front end part b1 of shaft-shaped member b is inserted and squeezed into space a2 of boss a1, naturally becomes greater. This increases the work load during manufacturing and also causes the problem of increasing the manufacturing time and manufacturing cost.

Further, there is a fear that with the piston body of a resin molding, the boss and the front end of the threaded portion deform more than required at the time of press-fitting, causing breakdown and cracks, inviting degradation of yield.

Patent document 1:
Japanese Patent Application Laid-open Hei 9-322819
Patent document 2:
Japanese Patent Application Laid-open 2004-89592
Patent document 3:
Japanese Patent Application Laid-open Hei 9-192581
Patent document 4:
Japanese Patent No. 3081834
Patent document 5:
Japanese Utility Model Registration No. 2603088

DISCLOSURE OF INVENTION

Problems to be Solved by the Invention

In view of the conventional problems described above, the present invention is to solve the problems, and it is therefore an object of the invention to provide a liquid applicator which enables easy application of an application liquid over a wide area even if the liquid is high in viscosity.

It is another object of the invention to provide a liquid applicator which includes a mechanism of pressurizing and depressurizing the application liquid such as a cosmetic inside the main body by moving a piston forwards and rearwards and which can prevent the mechanism from undergoing a load more than required during manipulation so as to reliably prevent unintended deformation, breakdown and other damage from occurring.

Means for Solving the Problems

The configurations of the liquid applicator according to the present invention in order to achieve the above objects are as follows:

The present inventors hereof have completed the present invention by focusing on the fact that use of an elastic material for an applying member is preferable to apply a liquid over a soft elastic object and have found that the above objects can be achieved by the combination of using a liquid pressing mechanism provided for the main body and forming an applying member so that its applying portion is projected further forwards beyond its ejection opening of a communication path.

The first aspect of the present invention resides in a liquid applicator comprising: a liquid pressing means for pressurizing an application liquid inside a main body so as to supply the application liquid to an applying member at the front end by the pressing of the liquid pressing means, and is characterized in that the applying member is made of an elastic material and is formed with a communication path for communication between the inside and outside of the main body, and the applying portion of the applying member is formed projected further forward from an ejection opening of the communication path.

The second aspect of the present invention is characterized in that, in the above first configuration, the applying portion projected from the ejection opening constitutes a liquid retainer for temporarily retaining the application liquid or includes the liquid retainer.

The third aspect of the present invention resides in the above first configuration, further comprising a liquid depressurizing means for depressurizing the application liquid inside the main body, and is characterized in that after usage of the applying member the application liquid in the communication path is drawn back into the interior of the main body side by depressurizing the application liquid inside the main body using the depressurizing means.

The fourth aspect of the present invention is characterized in that, in any one of the first to third configurations, the material of the elastic body used for the applying member is rubber, elastomer or closed-cell foam that is restorable.

The fifth aspect of the present invention resides in a liquid applicator which includes an applying member at the front end of a tubular main body and is adapted to feed an application liquid to the applying member at the front end by pressurizing the application liquid stored in a storing space inside the main body by means of a liquid pressurizing/depressurizing mechanism attached to the main body and draw back the application liquid by depressurizing, and is characterized in that the liquid pressurizing/depressurizing mechanism includes a piston body that moves forwards and backwards relative to the storing space inside the main body to decrease and increase the volume of the storing space, and a driving mechanism that has a shaft-shaped member whose front part is engaged with the rear part of the piston body so as to allow the user to apply actuating force to drive the shaft-shaped member forwards and backwards to thereby move the piston body forwards and backwards; an engaging portion having an interior space that opens rearwards is projectively formed to the rear in the rear of the piston body, and an insert hole that opens the interior space sidewards is formed on part of the side surface portion of the projected engaging portion in such a manner that, as to the distance between the opposing surfaces of the inner wall portion that defines the interior space, the distance on the front side is greater than the distance on the rear side by forming a stepped portion in between; an engaging projected portion that is projected sidewards is formed in the front end part of the shaft-shaped member; and the front end part of the shaft-shaped member is positioned inside the interior space through the insert hole, so that the engaging projected portion is hooked on the stepped portion in the inner wall portion, whereby the front part of the shaft-shaped member is engaged with the engaging portion in the rear part of the piston body.

The sixth aspect of the present invention is characterized in that, in the above fifth configuration, the engaging portion in the rear part of the piston body is formed with the inner wall portion and stepped portion so that it, ranging from the insert hole to the interior space, assumes an approximately T-shaped configuration when viewed from the side, and the engaging projected portion at the front end of the shaft-shaped member is formed in a flange shape whose width corresponds to the dimension of the interior space.

The seventh aspect of the present invention is characterized in that, in the above fifth or sixth configuration, a fixed cylindrical member in which a bore through which the shaft-shaped member is projected and retracted is formed at the front end on the side of the storing space and piston body, is fixed to the main body, and an annular projection that is projected forwards around the bore is formed in the front end part of the fixed cylindrical member, the inside diameter of the annular projection, at least, at the front end being formed to be greater than the outside diameter of the rear end part of the engaging portion of the piston body.

The eighth aspect of the present invention is characterized in that, in the above seventh configuration, the inner peripheral surface of the annular projection in the front end part of the fixed cylindrical member and the outer peripheral surface of the rear end part of the engaging portion of the piston body are tapered reducing their diameter narrower toward the rear.

The ninth aspect of the present invention is characterized in that, in the above sixth or seventh configuration, a fixed cylindrical member in which a bore through which the shaft-shaped member is projected and retracted is formed at the front end on the side of the storing space and piston body, is fixed to the main body, the shaft-shaped member has a large-diametric portion whose diameter is enlarged sideward, formed in the rear of the engaging projected portion that engages the engaging portion in the rear part of the piston body, and when the piston body is retracted, the large-diametric portion is adapted to abut the front end face around the bore of the fixed cylindrical member to thereby restrain the shaft-shaped member from moving further rearwards.

The tenth aspect of the present invention is characterized in that, in the above fifth configuration, the shaft-shaped member has recessed grooves and a male thread formed on the peripheral surface thereof along its axial direction, the driving mechanism includes: the shaft-shaped member; a fixed cylindrical member, fixed inside the main body by inserting the opening at the rear end of the main body, and having a female thread in the front end part thereof that mates the male thread on the outer peripheral surface of the shaft-shaped member; and an advancing member that has the shaft-shaped member passed through an irregular engaging bore having projections mating the grooves of the shaft-shaped member so as to be movable forwards and rearwards and unrotatable relative to the shaft-shaped member and is attached to the main body so as to be rotatable from the outside of the main body, and the piston body is moved forwards and rearwards through the shaft-shaped member by rotating the advancing member, to thereby increase and decrease the pressure on the application liquid inside the storing space.

The eleventh aspect of the present invention is characterized in that, in the above tenth configuration, a cylindrical actuator through which the user performs rotational actuation is externally fitted in the rear part of the advancing member so as not to drop off, and either the inner periphery of the cylindrical actuator or the outer periphery in the rear part of the advancing member is formed with a groove while the other is formed with a projection that elastically engages the groove, and the engaging force between the groove and projection is set so that the engagement therebetween is disengaged when the rotational actuating force on the cylindrical actuator required to move the shaft-shaped member becomes equal to or greater than a fixed level.

In any one of the first to eleventh configurations of the present invention, it is preferred that a cam portion having projections and indentations arranged in the circumferential direction is formed on the inner periphery of the fixed cylindrical member while a projected portion that elastically abuts this cam portion is formed on the outer periphery of the advancing member, and that the projections and indentations of the cam portion is formed so that the rotational actuating force of the cylindrical actuator required to retract the shaft-shaped member is greater than the rotational actuating force required to advance it.

Further, the material of the elastic body used for the applying member is preferably rubber, elastomer or closed-cell foam that is restorable.

Effect of the Invention

According to any one of the above first to fourth configurations of the present invention, the applying member is formed of elastic material, the elastic material is formed with a communication path, and the communication path may be a passage hole.

Then, when the application liquid in the main body is pressurized by the liquid pressing means, the application liquid passes through the communication path and is ejected from the ejection opening.

Further, since the applying portion of the applying member is arranged further forward from the ejection opening of the communication path, the application liquid from the ejection opening can be reliably delivered to the applying portion.

Further, since the applying portion of the applying member is arranged further forward from the ejection opening of the communication path, the application liquid can be easily spread over the target area. Also, after usage the applying portion can be easily wiped, so there is no application liquid, which would adhere to the outside.

Accordingly, even if the application liquid is high in viscosity, it is not only possible to apply the application liquid in an easy manner but also protect the stored application liquid appropriately without being affected by contamination of microbes etc., outside and without being contaminated at all by microbes and the like from the external air and the outside.

Further, according to the second aspect of the present invention, provision of the liquid retainer for temporarily retaining the ejected application liquid in the applying part around the ejection opening of the above-described communication path, or formation of the applying part itself in such a configuration, makes it possible to temporarily hold the ejected application liquid in an efficient manner. This arrangement makes it possible to avoid dripping due to the liquid rushing out from the ejection opening. Further, this increases the permissivity for the pressurizing operation of the liquid pressing means. Also, after usage the application liquid puddled in this liquid retainer can be easily wiped with tissue, rag or the like, hence it is hygienically excellent.

Further, according to the third aspect of the present invention, a liquid depressurizing means for reducing the pressure on the application liquid inside the main body is provided, and when the pressurization on the application liquid is stopped and then the application liquid is depressurized by the liquid depressurizing means after usage of the application liquid, the application liquid can be intentionally drawn from the communication path into the main body side.

Accordingly, even if the application liquid being stored is viscous or high in viscosity and has such a viscosity as the application liquid will remain on the ejection side of the communication path when the liquid has been depressurized after use, it is possible to by forcibly pull the application liquid from the communication path by depressurizing the application liquid using the liquid depressurizing means.

As a result, after usage of the liquid applicator no application liquid will be present outside the ejection opening of the communication path. Accordingly, whether the application liquid is high or low in viscosity, it is possible to completely eliminate the occasions of the application liquid being exposed to the outside air, being affected by contamination of microbes etc., outside and being contaminated at all by microbes and the like from the external air and the outside and to appropriately and definitely protect the stored application liquid.

According to the fifth aspect of the present invention, an engaging portion having an interior space that opens rearwards is projectively formed to the rear in the rear of the piston body; an insert hole that opens the interior space sidewards is formed on part of the side surface portion of the projected engaging portion in such a manner that, as to the distance between the opposing surfaces of the inner wall portion that defines the interior space, the distance on the front side is greater than the distance on the rear side by forming a stepped portion in between; an engaging projected portion that is projected sidewards is formed in the front end part of the shaft-shaped member; and the front end part of the shaft-shaped member is positioned inside the interior space through the insert hole, so that the engaging projected portion is hooked on the stepped portion in the inner wall portion, whereby the front part of the shaft-shaped member is engaged with the engaging portion in the rear part of the piston body. Accordingly, the front end part of the shaft-shaped member can be positioned inside the interior space by passing it through the insert hole. As a result, it is possible to pass the engaging projected portion at the front end of the shaft-shaped member through the insert hole without any resistance when it is set in the interior space. Since it is no longer necessary to fit the engaging projected portion in a squeezing manner as conventionally done, it is possible to designate the height of the engaging projected portion and stepped portion freely depending on the engaging force required.

Further, since it is possible to engage the front part of the shaft-shaped member with the rear part of the piston body with an engaging force that can be set freely when the engaging projected portion is hooked on the stepped portion of the inner wall portion, the engaging projected portion is hooked on and engaged securely with the stepped portion of the inner wall portion when the shaft-shaped member is retracted.

According to the sixth aspect of the present invention, when in the fifth configuration, the engaging portion in the rear part of the piston body is formed with the inner wall portion and stepped portion so that it, ranging from the insert hole to the interior space, assumes an approximately T-shaped configuration when viewed from the side, and the engaging projected portion at the front end of the shaft-shaped member is formed in a flange shape whose width corresponds to the dimension of the interior space, it is possible to engages the front end part of the shaft-shaped member with the engaging portion more securely and reliably.

According to the seventh aspect of the present invention, a fixed cylindrical member in which a bore through which the shaft-shaped member is projected and retracted is formed at the front end on the side of the storing space and piston body, is fixed to the main body, and an annular projection that is projected forwards around the bore is formed in the front end part of the fixed cylindrical member, the inside diameter of the annular projection, at least, at the front end being formed to be greater (preferably, greater to some extent such that the engaging portion fits in) than the outside diameter of the rear end part of the engaging portion of the piston body. Accordingly, the rear end part of the engaging portion of the piston body fits into the inside of the annular projection when the piston body is retracted to the limit.

If the shaft-shaped member is moved further to the rear by the driving mechanism, the engaging projection at the front end of the shaft-shaped member exerts force that tends to deform the engaging portion of the piston body to expand the interior space that is connected to the insert hole. However, the rear end part of this engaging portion is fitted into the inside of the aforementioned annular projection so that it is possible to prevent deformation because the annular projection exerts force against deformation from the outside.

Accordingly, no malfunctions such as displacement of the engaging projected portion of the shaft-shaped member from the engaging portion of the piston body and the like occur, which would occur due to deformation such as enlargement of the engaging portion.

Accordingly, it is possible to surely prevent malfunctions of the piston body unmovable due to displacement of the shaft-shaped portion from the engaging portion, thus to prevent inconvenience that the application is hampered.

Here, the annular projection may be constructed such that the inside diameter of, at least, the front end is formed to be greater by 0.1 to 2 mm (preferably, greater to some extent such that the engaging portion fits in marginally closely) than the outside diameter of the rear end part of the engaging portion of the piston body. As a result it is possible to quickly exert anti-deformation effect on the engaging portion because the inner periphery of the annular projection abuts the engaging portion as soon as it is about to deform.

According to the eighth aspect of the present invention, when in the seventh configuration, the inner peripheral surface of the annular projection in the front end part of the fixed cylindrical member and the outer peripheral surface of the rear end part of the engaging portion of the piston body are tapered reducing their diameter narrower toward the rear, the rear end part of the engaging portion of the piston body fits into the inside of the annular projection when the piston body is retracted to the limit. Then, if the shaft-shaped member is moved further to the rear by the driving mechanism, the engaging projection at the front end of the shaft-shaped member is squeezed to be smaller in diameter by the tapered inner peripheral surface of the aforementioned annular projection. Accordingly, the force tending to deform the engaging portion of the piston body so as to expand the interior space can be countered more strongly by the force that the annular projection exerts to prevent deformation from the outside, hence it is possible to further reliably prevent deformation.

According to the ninth aspect of the present invention, in the fifth or sixth configuration, the shaft-shaped member has a large-diametric portion whose diameter is enlarged sideward, formed in the rear of the engaging projected portion that engages the engaging portion in the rear part of the piston body, and when the piston body is retracted, the large-diametric portion is adapted to abut the front end face around the bore of the fixed cylindrical member to thereby restrain the shaft-shaped member from moving further rearwards. Accordingly, the force of moving the shaft-shaped member rearwards will not act on the piston body, it is hence possible to prevent the engaging portion from deforming in a more improved way.

DESCRIPTION OF REFERENCE NUMERALS

Figure 1A:
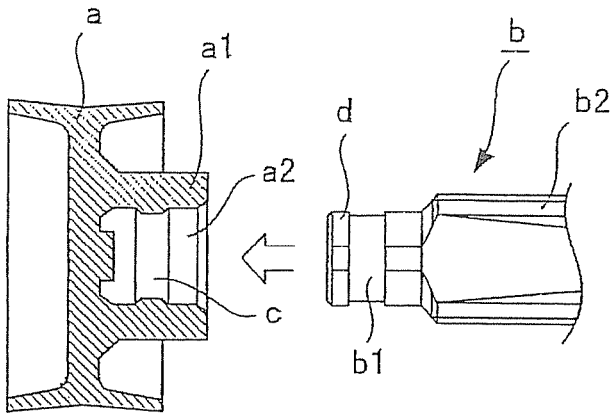
FIG. 1(a) PRIOR ART
FIGS. 1(*a*) and 1(*b*) show a piston body that moves forwards and rearwards inside a conventional main body (inside a liquid storing chamber) and a front end part of a shaft-shaped member that engages a boss of the piston body.
Figure 1B:
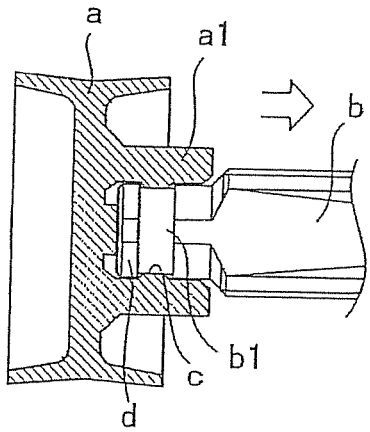
FIG. 1(b) PRIOR ART

1 liquid applicator
2 main body
2*a* small-diametric portion
2*b* application liquid storing space (storage tank)
3 front barrel
4 application liquid
6 liquid pressing mechanism (liquid pressing means)
7 cap
8 ejection opening
10 applying member
10*a* applying portion
10*b* bore
10*c* flange-like portion
12 pipe joint
12*a* passage hole
13 application liquid feed pipe
20 liquid applicator
21 tapered portion
23 shoulder
24 communication path
25 flat portion (temporal liquid retainer)
26 roughened surface portion
31 rotary actuator
32 threaded rod (shaft-shaped member)
32*a* cylindrical part
34 holder
34*a* large-diametric portion
34*b* small-diametric portion
35 piston body
35*a* gasket element
35*b* proximal part
36 outer sleeve cap
37 inner sleeve member
38 meshing portion
39 engaging portion (inner cam portion)
41 liquid retainer
42 acute portion
43 Roughly shovel-like portion
44 comb portion
45 communication path
47 liquid retainer
48 forked claw
50 liquid applicator
51 cap
52 storage tank
54 liquid depressurizing mechanism (liquid depressurizing means)
55 action converter
56 outer sleeve cap
57 inner sleeve member
58 elastic structure
58*a* projection

59 elastic structure
59*a* projection
60 flange portion
61 meshing portion
141 interior space
142 engaging portion
143 insert hole
144 inner wall portion
145 stepped portion
146 engaging projected portion
147 leading slot
148 annular projection
149 front end part
150 front end part
151 large-diametric portion
A Outside diameter of the cylindrical portion of the shaft-shaped member
B Cutout width of the leading slot
C Entrance width of the leading slot
D1 Opposing distance on the rear side
D2 Opposing distance on the front side
R Clockwise direction (pressurizing direction)

BEST MODE FOR CARRYING OUT THE INVENTION

Referring next to the accompanying drawings, the present invention will be detailed based on the best mode of a liquid applicator. However, the liquid applicator of the present invention should not be limited to the following embodiments.

Figure 2:
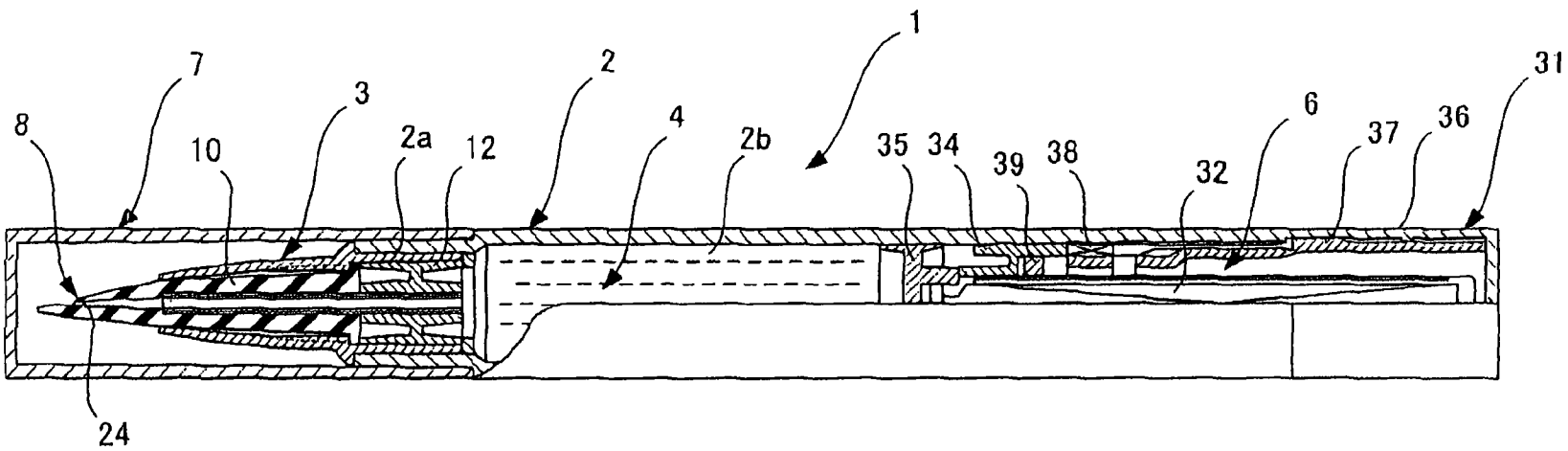
FIG. 2 is a sectional side view according to the first embodiment of a liquid applicator of the present invention.

FIG. 2 is a sectional side view of a liquid applicator according to the first embodiment.

Figure 3A:
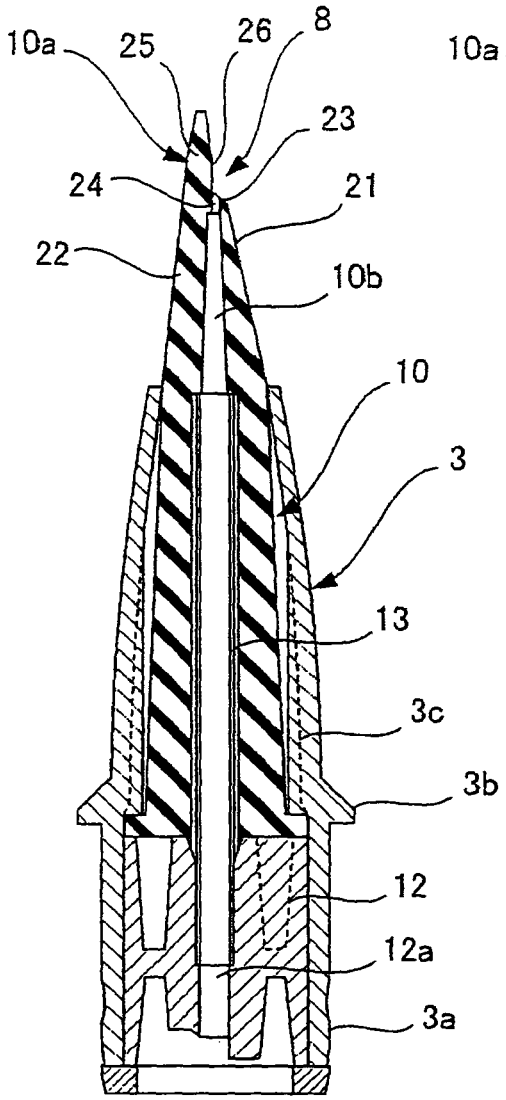
FIGS. 3(*a*), 3(*b*) and 3(*c*) are a sectional side view of the structure of the front barrel portion of the first embodiment of a liquid applicator, its half-sectional, plan view and its view observed in the axial direction from the front end, respectively.
Figure 3B:
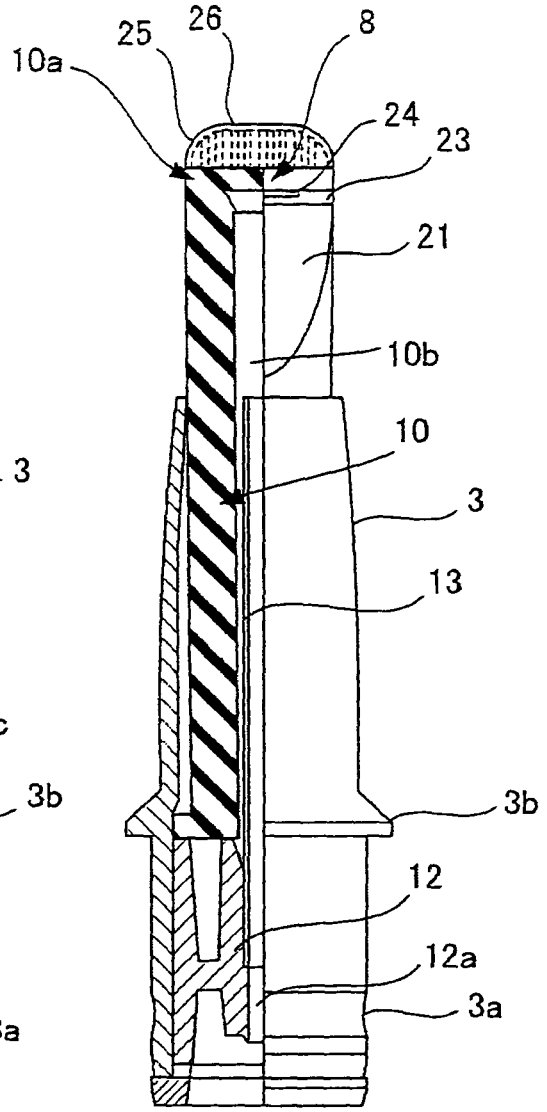
Figure 3C:
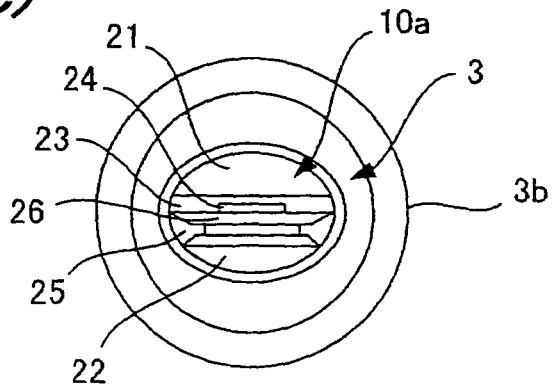

FIGS. 3(*a*), 3(*b*) and 3(*c*) are a sectional side view of the structure of the front barrel portion of the first embodiment of a liquid applicator, its half-sectional, plan view and its view observed in the axial direction from the front end, respectively.

Figure 4A:
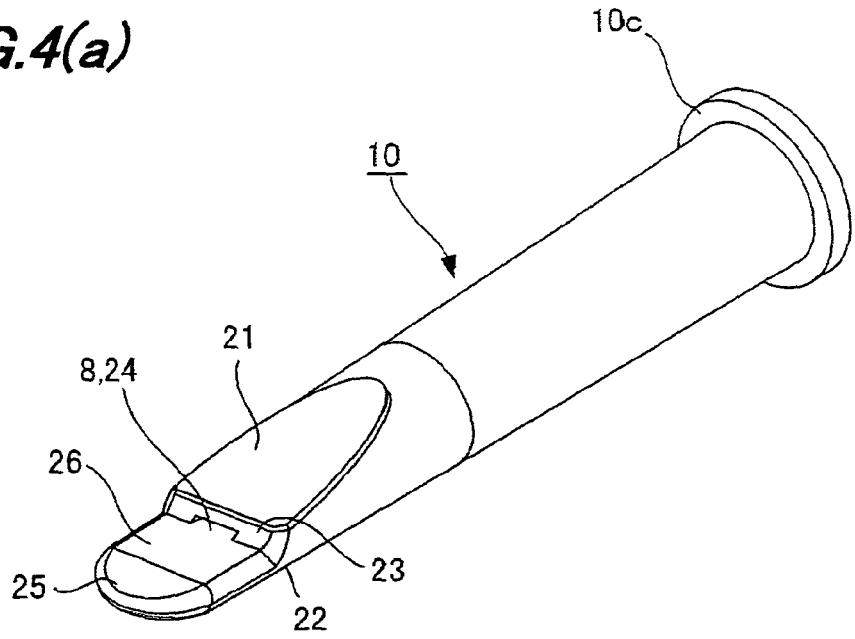
FIGS. 4(*a*) and 4(*b*) are a perspective view and vertical sectional view showing an applying member provided for the liquid applicator of FIG. 3.
Figure 4B:
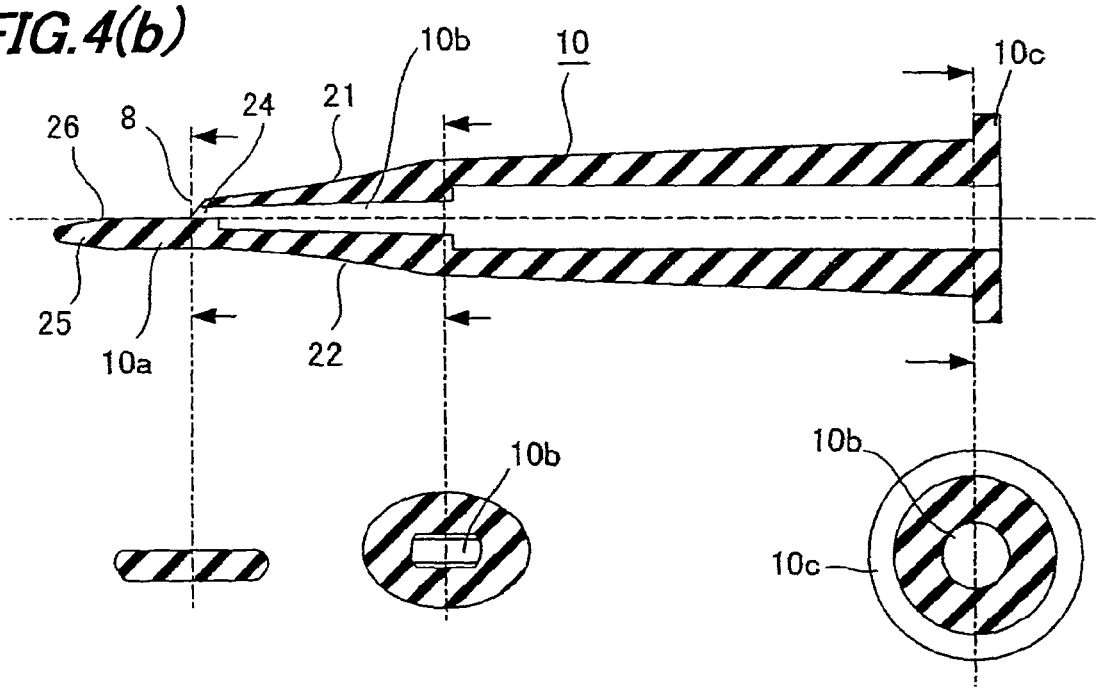

FIGS. 4(*a*) and 4(*b*) are a perspective view and vertical sectional view showing an applying member provided for the liquid applicator of FIG. 3.

Figure 5A:
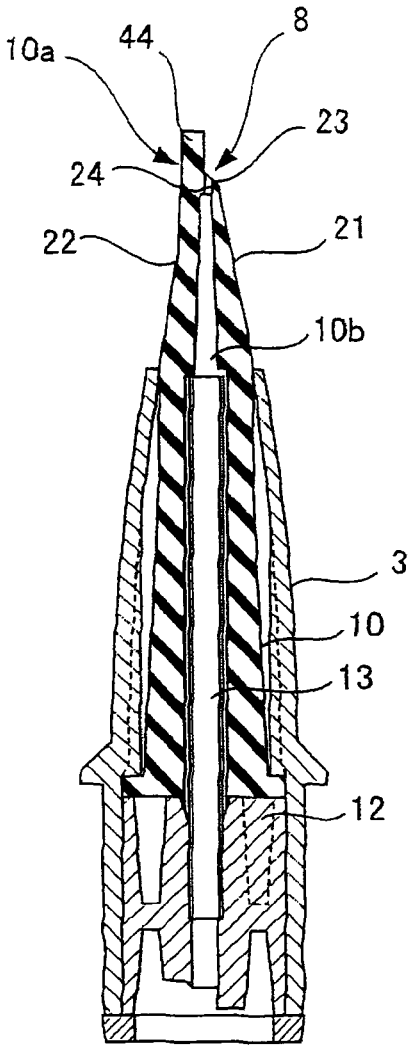
FIGS. 5(*a*), 5(*b*) and 5(*c*) are a sectional side view of the structure of the front barrel portion of the second embodiment of a liquid applicator, its half-sectional, plan view and its view observed in the axial direction from the front end, respectively.
Figure 5B:
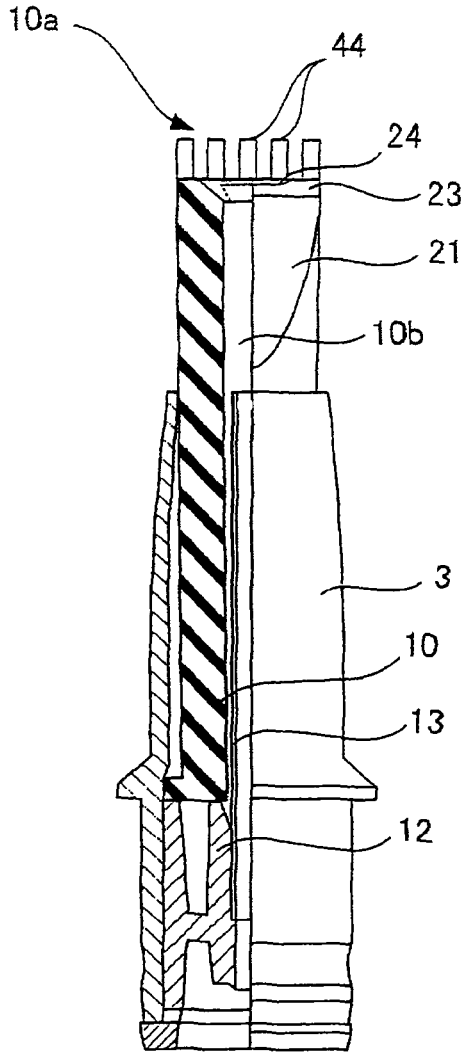
Figure 5C:
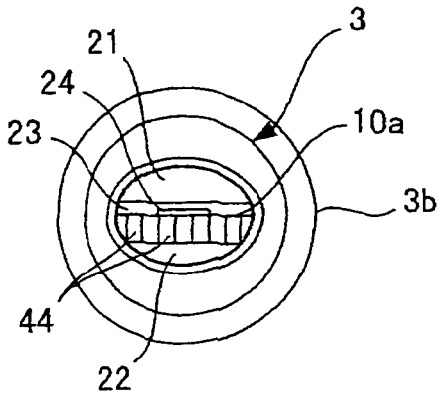

FIGS. 5(*a*), 5(*b*) and 5(*c*) are a sectional side view of the structure of the front barrel portion of the second embodiment of a liquid applicator, its half-sectional, plan view and its view observed in the axial direction from the front end, respectively.

Figure 6A:
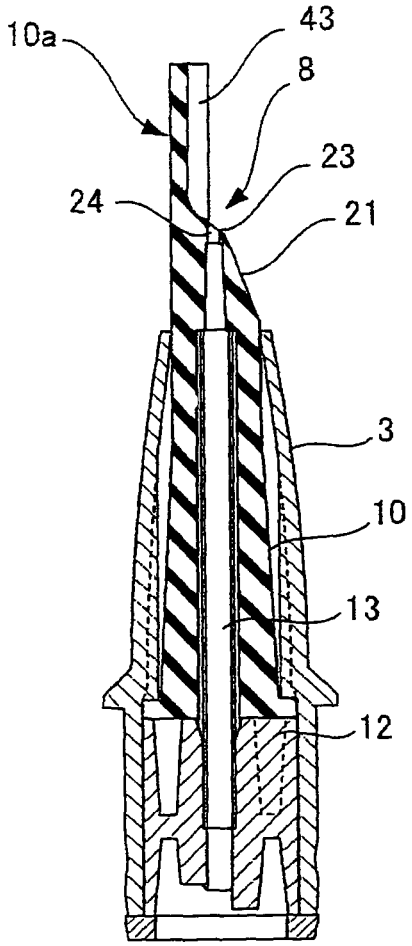
FIGS. 6(*a*), 6(*b*) and 6(*c*) are a sectional side view of the structure of the front barrel portion of the third embodiment of a liquid applicator, its half-sectional, plan view and its view observed in the axial direction from the front end, respectively.
Figure 6B:
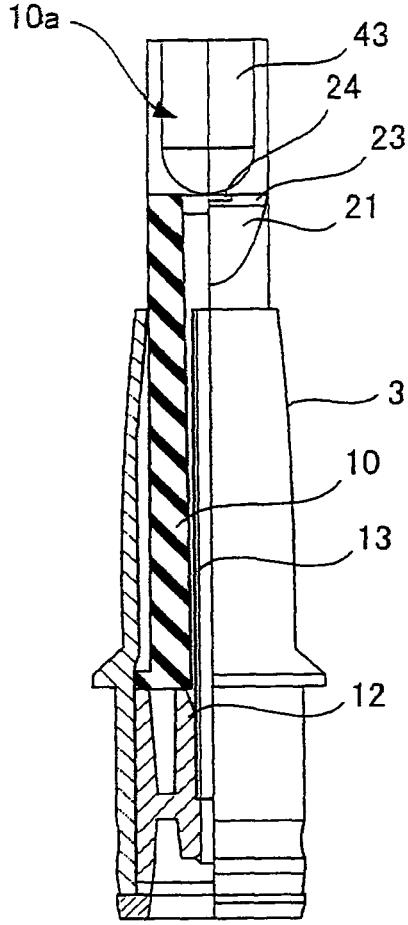
Figure 6C:
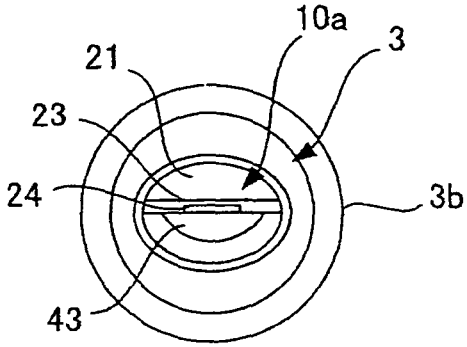

FIGS. 6(*a*), 6(*b*) and 6(*c*) are a sectional side view of the structure of the front barrel portion of the third embodiment of a liquid applicator, its half-sectional, plan view and its view observed in the axial direction from the front end, respectively.

Figure 7A:
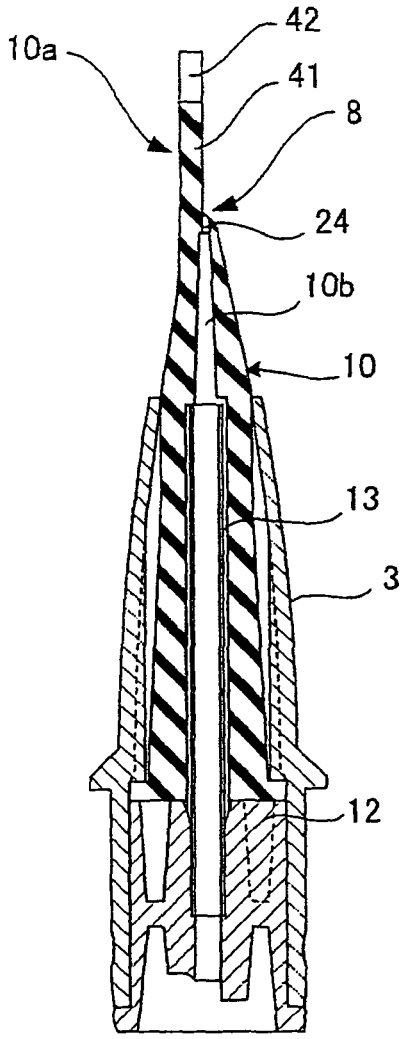
FIGS. 7(*a*), 7(*b*) and 7(*c*) are a sectional side view of the structure of the front barrel portion of the fourth embodiment of a liquid applicator, its half-sectional, plan view and its view observed in the axial direction from the front end, respectively.
Figure 7B:
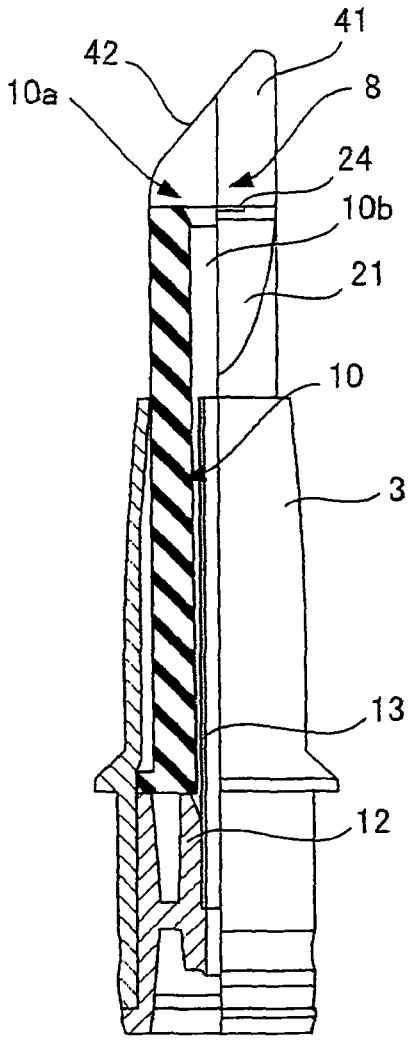
Figure 7C:
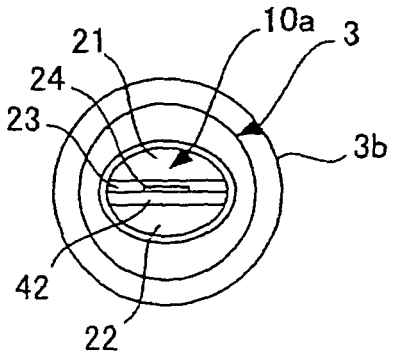

FIGS. 7(*a*), 7(*b*) and 7(*c*) are a sectional side view of the structure of the front barrel portion of the fourth embodiment of a liquid applicator, its half-sectional, plan view and its view observed in the axial direction from the front end, respectively.

Figure 8A:
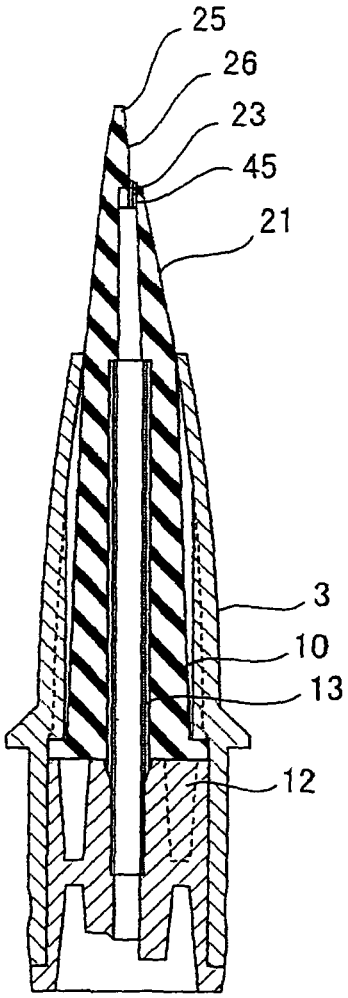
FIGS. 8(*a*), 8(*b*) and 8(*c*) are a sectional side view of the structure of the front barrel portion of the fifth embodiment of a liquid applicator, its half-sectional, plan view and its view observed in the axial direction from the front end, respectively.
Figure 8B:
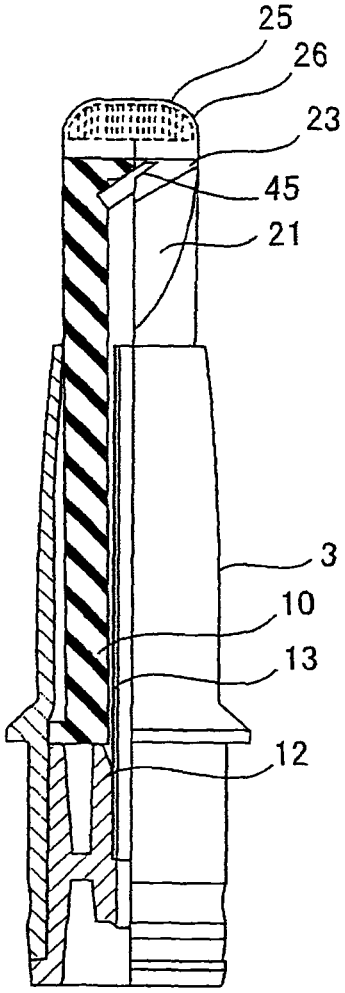
Figure 8C:
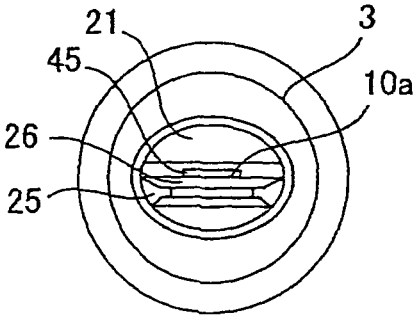

FIGS. 8(*a*), 8(*b*) and 8(*c*) are a sectional side view of the structure of the front barrel portion of the fifth embodiment of a liquid applicator, its half-sectional, plan view and its view observed in the axial direction from the front end, respectively.

Figure 9A:
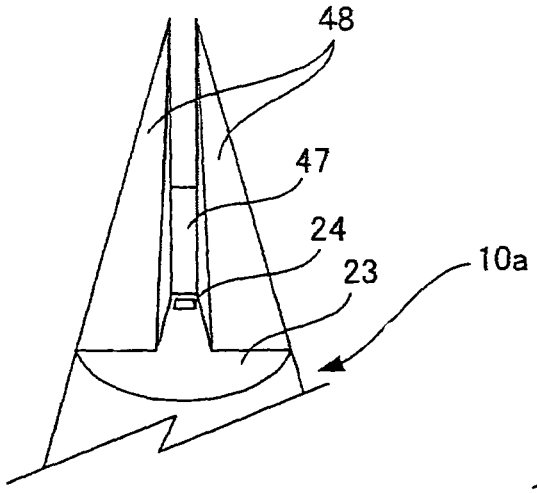
FIGS. 9(*a*) and 9(*b*) are a side view and plan view showing a configuration of an applying part according to the sixth embodiment of a liquid applicator, respectively.
Figure 9B:
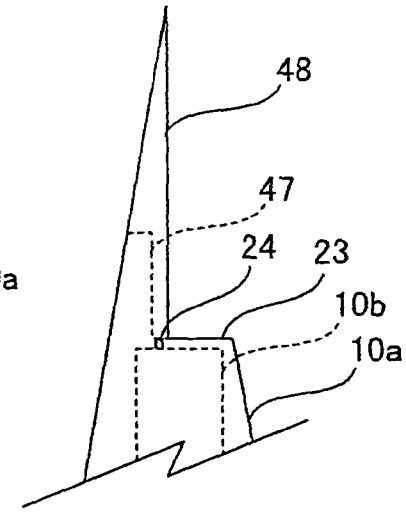

FIGS. 9(*a*) and 9(*b*) are a side view and plan view showing a configuration of an applying part according to the sixth embodiment of a liquid applicator, respectively.

Figure 10:
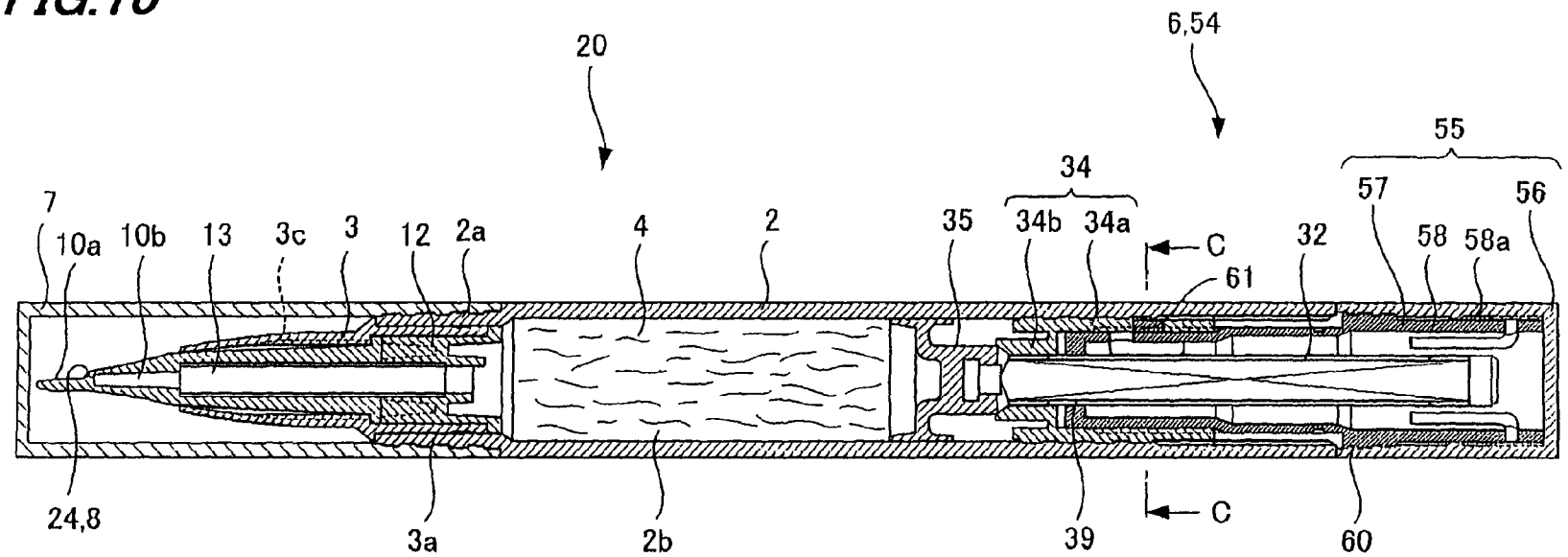
FIG. 10 is a vertical sectional view according to the seventh embodiment of a liquid applicator.

FIG. 10 is a vertical sectional view according to the seventh embodiment of a liquid applicator.

Figure 11A:
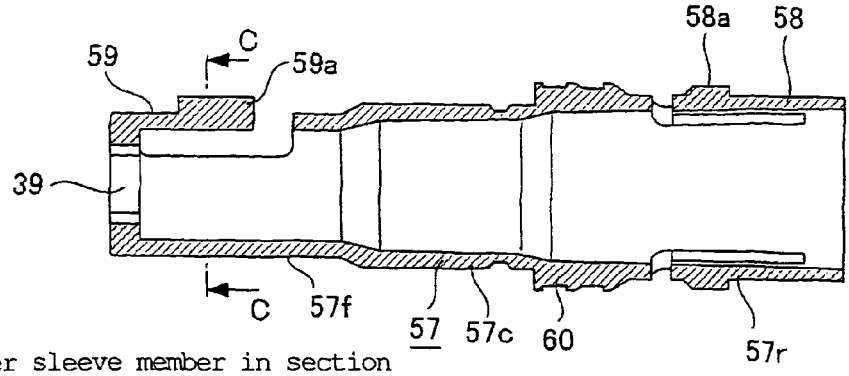
FIGS. 11(*a*), 11(*b*) and 11(*c*) are a vertical sectional view of an inner sleeve member for a rotary actuator according the seventh embodiment of a liquid applicator, its perspective view and a cross-sectional view cut along a line C-C in FIG. 10, respectively.
Figure 11B:
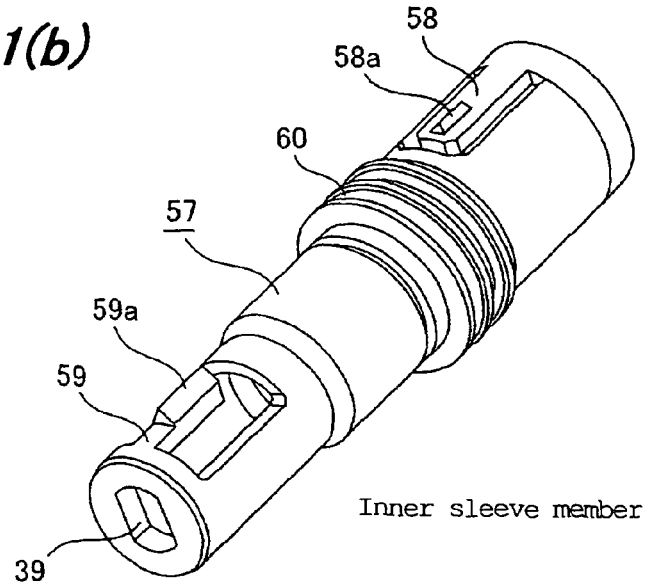
Figure 11C:
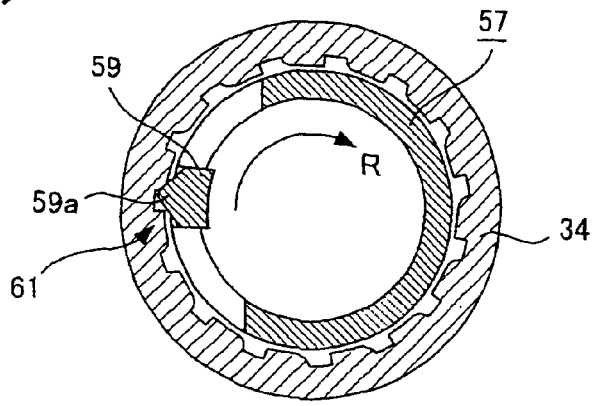

FIGS. 11(*a*), 11(*b*) and 11(*c*) are a vertical sectional view of an inner sleeve member for a rotary actuator according the seventh embodiment of a liquid applicator, its perspective view and a cross-sectional view cut along a line C-C in FIG. 10, respectively.

Figure 12:
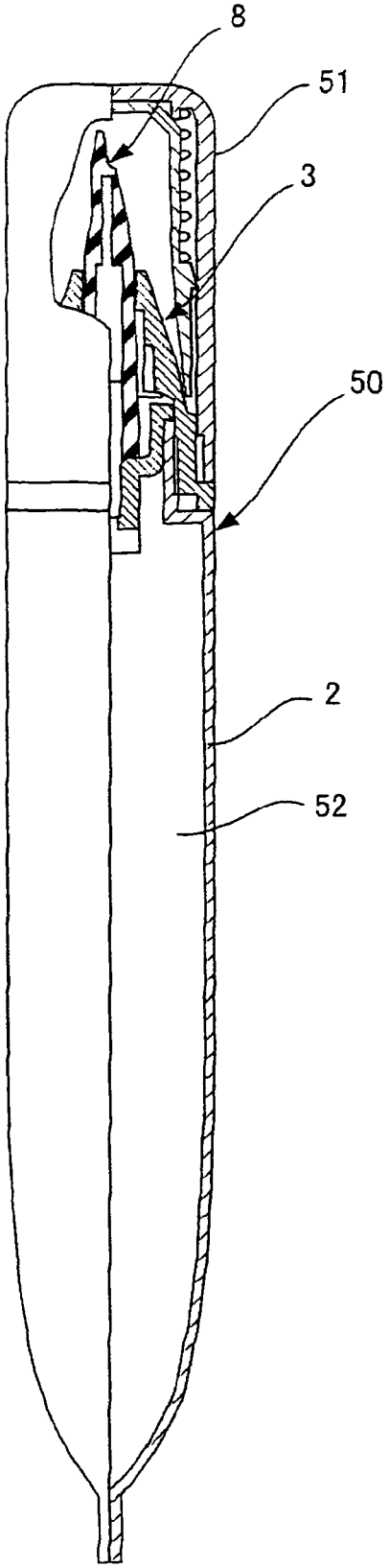
FIG. 12 is a partial sectional side view showing a liquid applicator having a liquid pressing mechanism according to the eighth embodiment of a liquid applicator.

FIG. 12 is a partial sectional side view showing a liquid applicator having a liquid pressing mechanism according to the eighth embodiment of a liquid applicator.

As shown in FIGS. 2 to 4, a liquid applicator 1 according to the first embodiment has a liquid pressing mechanism (liquid pressing means) 6 for pressurizing an application liquid 4 inside a main body 2 so as to supply application liquid 4 to an applying member 10 by the pressing of liquid pressing mechanism 6.

The aforementioned applying member 10 is made of an elastic material and formed with a communication path 24 of a passage hole for communication between the inside and outside of main body 2, and an applying portion 10*a* of the aforementioned applying member 10 is formed projected further forward from an ejection opening 8 of communication path 24.

Also, as shown in FIG. 2, liquid applicator 1 includes, as essential parts, main body 2 as an outer sleeve, a front barrel 3 arranged in front of main body 2, application liquid 4 inside the main body, applying member 10, liquid pressing mechanism 6, a cap 7 that covers applying member 10.

Main body 2 has a roughly tubular hollow configuration with its front end formed with a small-diametric portion 2*a* having an outside diameter approximately equal to the inside diameter of tapering cap 7. Cap 7 is detachably fitted to the small-diametric portion 2*a*.

A proximal end of front barrel 3 is fluid-tightly fitted inside the bore of small-diametric portion 2*a* of main body 2 while liquid pressing mechanism 6 is arranged at the rear end of main body 2 so that a piston body (gasket) 35 of liquid pressing mechanism 6 is arranged hermetically so as to move slidably along the inner wall of the bore in the rear end of main body 2.

Accordingly, the portion enclosed by the main body 2 interior, the rear end of front barrel 3 and piston body 35 constitutes an application liquid storing space (storage tank) 2*b* for application liquid 4.

Liquid pressing mechanism 6 is composed of, as essential parts, a rotary actuator 31, a threaded rod 32 (also called "shaft-shaped member" or "pusher") and a holder 34 for threaded rod 32 and the aforementioned piston body 35.

Rotary actuator 31 is formed of an outer sleeve cap 36 and an inner sleeve member 37, being joined to each other in an unrotatable manner, and the rotatable actuator 31 as a whole is arranged rotatably in the rear part of main body 2.

Holder 34 is an annular part and is unrotatably inserted into and attached to main body 2. Formed in a meshing portion 38 between holder 34 and rotary actuator 31 (the outer peripheral surface in the front part of inner sleeve member 37) is a ratchet, so that rotary actuator 31 is restrained in its rotation, or is permitted to rotate in one direction only with respect to holder 34 (or main body 2 fixed to it). In addition to this, it is also possible to provide a torque limiter function which releases its constraint and permits rotation when a rotational force beyond a fixed level acts in the one direction.

A male thread is formed on the outer periphery of threaded rod 32 and the male thread is mated into a female thread formed in the center bore of holder 34. The outer peripheral part of threaded rod 32 has an irregular cam shape when viewed cross-sectionally (e.g., having an approximately oval shape by forming cutouts at both sides with respect to the diameter, when viewed cross-sectionally) while as an engaging portion (also called "inner cam portion") 39 (at a further front part of meshing portion 38) on inner sleeve member 37 of rotary actuator 31, an irregular cam shape corresponding to the outer peripheral shape of threaded rod 32 is formed on its center bore The aforementioned threaded rod 32 is inserted to pass through the center bore of engaging portion 39, whereby threaded rod 32 is engaged with rotary actuator 31 (by way of engaging portion 39) so as to be able to slide in the axial direction in a relatively unrotatable manner.

The front end of threaded rod 32 is connected to piston body 35. As rotary actuator 31 turns in the predetermined direction, threaded rod 32 advances by the means of holder 34 toward the front end of main body 2, so as to cause piston body 35 to move forwards and press application liquid 4.

As shown in FIGS. 3 to 4, front barrel 3 has a tapering tubular structure which is reduced in diameter as it goes toward the front end (in the front part from an aftermentioned flange 3*b* in the embodiment), and holds applying member 10 in its interior space that opens at its front and rear sides, with the front end of applying member 10 sticking out. This front barrel is fixed to main body 2 as it holds the applying member. As will be described later, applying member 10 has a shape which becomes narrower and flatter as it goes toward the front.

An annular fitting recess 3*a* is formed around the outer periphery in the rear end part of front barrel 3. Fitting recess 3*a* is press fitted with an annular fitting projection (not shown) formed on the inner surface of small-diametric portion 2*a* of main body 2 so as to prevent front barrel 3 from coming off main body 2.

Formed also on the outer periphery of front barrel 3 (at the approximate center with respect to the axial direction) is flange 3*b*, which abuts the front end face of small-diametric portion 2*a* of main body 2.

A plurality of ribs 3*c* projected toward the axis and extending in the axial direction are formed equi-distantly on the inner peripheral surface of this front barrel 3. The rear end faces of these ribs 3*c* and the front end face of a pipe joint 12 sandwich the flanged portion 10*c* that is enlarged in diameter at the rear part of applying member 10 so as to hold and fix applying member 10 inside front barrel 3.

Applying member 10 is formed of an elastic member and is supported by pipe joint 12 and an application liquid feed pipe 13. Application liquid feed pipe 13 is inserted and fixed in a passage hole 12*a* at the center of pipe joint 12 and is inserted into a bore 10*b* provided for applying member 10, from its rear end up to the middle part (front end of front barrel 3) where the bore is enlarged in diameter, to also serve as a liquid leakage preventing function.

Applying member 10 has a flat tapering structure with tapered portions 21 and 22 formed on both sides thereof. The upper tapered portion 21 is formed with a step, where, in shoulder 23 thereof, ejection opening 8 of communication path 24 opens in a laterally long rectangular shape along the flattened direction. Applying portion 10*a* of applying member 10 is formed further frontward from ejection opening 8 of communication path 24.

Communication path 24 is connected to bore 10*b* formed inside applying member 10 in its axial direction, so that application liquid 4 flows through communication path 24 by way of bore 10*b* when application liquid 4 is pressurized by liquid pressing mechanism 6.

In the present invention, applying member 10 may be totally formed of elastic material, or applying portion 10*a* alone may be formed of elastic material with the basic part formed of a non-elastic material that is hard to deform. The material for applying portion 10*a* is an elastic material, examples of elastic material including rubber, elastomer etc. Further, as the material for applying portion 10*a*, for example, elastic material without continuous foams, or elastic material having no foam and closed cell foam elastic material may be used without problems as long as it presents fluid-tightness.

(1) Examples of rubber include NBR, silicone rubber, EPDM, fluorosilicone rubber, fluororubber, urethane rubber, natural rubber, chlorobrene rubber, butadiene rubber, butyl rubber and the like.

(2) Examples of elastomer include styrene elastomer, vinyl chloride elastomer, olefin elastomer, polyester elastomer, polyamide elastomer, urethane elastomer and the like.

(3) Examples of closed cell foam include polyethylene foam, vinyl chloride foam, polystyrene foam and the like.

As shown in FIGS. 3 to 4, applying portion 10*a* is the part that is extended from shoulder 23 formed as a step and is formed as a flat portion 25. One side of flat portion 25 is formed with a roughened surface portion 26. Communication path 24 is opened by forming laterally long ejection opening 8 in shoulder 23 as stated above. Communication path 24 is formed so that part of its inner surface and one side of ejection opening 8 are formed on the continuous face with the aforementioned roughed surface 26.

Application liquid 4 ejected from ejection opening 8 of communication path 24 is temporarily retained on roughened surface portion 26 of flat portion 25. The retained amount of the application liquid on this portion depends on the type of the cosmetic used. Also, since part of communication path 24 and one side of ejection opening 8 are formed on the continuous surface with the aforementioned roughened surface 26 as stated above, the application liquid pushed out flows out smoothly onto roughened surface 26 without stagnation.

In the thus configured liquid applicator 1, in its normal condition the interior of main body 2, the interior of pipe joint 12 of front barrel 3, the interior of application liquid feed pipe 13 and bore 10*b* of applying member 10 are filled with application liquid 4. When the user turns rotary actuator 31 of liquid pressing mechanism 6 upon its usage, the rotation of rotary actuator 31 causes threaded rod 32 to rotate by drive transfer of engaging portion 39 and advances toward the front end by its screw engagement with holder 34.

This causes piston body 35 to advance toward the front end and pressurize application liquid 4 inside application liquid storing space 2*b*. Application liquid 4 is pushed out by the pressure toward applying portion 10*a* via communication path 24, whereby a predetermined amount of application liquid 4 is ejected from ejection opening 8.

The ejected application liquid 4, though some part may rush out, is temporarily retained over roughened surface portion 26 of flat portion 25 that extends to the front end, and lead and applied to a soft applied surface such as skin etc. After the end of application, the application liquid puddled on flat portion 25 can be easily wiped by tissue, rag or the like.

Also, since liquid pressing mechanism 6 uses a ratchet, it has a function of permitting rotary actuator 31 to rotate a predetermined amount only by a single action of rotary actuator 31 while pushing out piston body 35 by a predetermined distance every actuation. Accordingly, it is possible to exactly dispense a desired amount of the application liquid to applying portion 10*a*.

Accordingly, when pressurized, application liquid 4 is ejected from ejection opening 8 and dispensed for smooth usage.

Further, provision of flat portion (liquid retainer) 25 for temporarily holding the ejected application liquid 4 in applying portion 10*a* near ejection opening 8 of communication path 24, makes it possible to prevent the ejected application liquid 4 from dripping even if the liquid abruptly rushes out.

As understood from the above, the application liquid 4 that comes in contact with the external air after usage is limited to that residing in applying portion 10*a* from ejection opening 8, which can be easily removed. As a result, it is not only possible to apply application liquid 4 easily even though it is high in viscosity, but also fully protect the stored application liquid 4 against the contamination by microbes and the like from the external air and outside environment.

FIG. 5 is a view showing an applying part according to the second embodiment of a liquid applicator according to the present invention.

Since the liquid applicator shown in FIG. 5 has almost the same structure as that of the front barrel shown in FIG. 3 except for its applying member 10, the same and similar components are allotted with like reference numerals and their detailed description is omitted.

As shown in FIG. 5, a comb portion 44 is formed further forwards from ejection opening 8 that is located at shoulder 23 of applying member 10 to open communication path 24. The application liquid 4 ejected from ejection opening 8 temporarily adheres to comb portion 44 or is retained by surface tension of the liquid or the like. That is, comb portion 44 functions as a liquid retainer for temporary retention and also plays a central role of applying portion 10*a*.

FIG. 6 is a view showing an applying part according to the third embodiment of a liquid applicator according to the present invention.

Since the liquid applicator shown in FIG. 6 has almost the same structure as that of the front barrel shown in FIG. 3 except for its applying member 10, the same and similar components are allotted with like reference numerals and their detailed description is omitted.

As shown in FIG. 6, a roughly shovel-like portion 43 such as a shovel, spade or the like is formed further forwards from ejection opening 8 that is located at shoulder 23 of applying member 10 to open communication path 24. The application liquid 4 ejected from ejection opening 8 temporarily held. That is, roughly shovel-like portion 43 is formed as a temporary retainer of the liquid and also plays a central role of applying portion 10*a*.

FIG. 7 is a view showing an applying part according to the fourth embodiment of a liquid applicator according to the present invention.

Since the liquid applicator shown in FIG. 7 has almost the same structure as that of the front barrel shown in FIG. 3 except for its applying member 10, the same and similar components are allotted with like reference numerals and their detailed description is omitted.

As shown in FIG. 7, a temporary liquid retainer 41 that is extended further forwards from ejection opening 8 that is located at shoulder 23 of applying member 10 to open communication path 24 is formed in a knife-like form having an acute portion 42 at its front end. With this shape, it is possible to apply application liquid 4 exactly along the contours of the eyes and lips while temporarily holding the liquid.

FIG. 8 is a view showing an applying part according to the fifth embodiment of a liquid applicator according to the present invention.

Since the liquid applicator shown in FIG. 8 has almost the same structure as that of the front barrel shown in FIG. 3 except for its applying member 10, the same and similar components are allotted with like reference numerals and their detailed description is omitted.

In applying member 10 shown in FIG. 8, an ejection opening 8 that opens communication path 45 is formed obliquely with respect to the axial direction of applying member 10. Thus, in the present invention, the way of forming a slit for ejection opening 8 of communication path 45 can be changed as appropriate depending on the configurations of the applying part and the applied surface.

FIG. 9 is a view showing an applying part according to the sixth embodiment of a liquid applicator according to the present invention.

Since the liquid applicator shown in FIG. 9 has almost the same structure as that of the front barrel shown in FIG. 3 except for its applying member 10, the same and similar components are allotted with like reference numerals and their detailed description is omitted.

In applying portion 10*a* shown in FIG. 9, forked claws 48 are formed on both sides of a liquid retainer 47 that is extended further forwards from ejection opening 8 that is located at its shoulder 23 to open communication path 24. This configuration facilitates the application liquid to be retained between the claws by its surface tension and also enables preferable application over special applied surfaces.

FIG. 10 is a vertical sectional view showing the whole part of the seventh embodiment of a liquid applicator of the present invention, and FIG. 11 is a detailed illustrative view of a rotary actuator.

Since a liquid applicator 20 shown in FIG. 10 has almost the same structure as that in the first embodiment of a liquid applicator of the present invention shown in FIGS. 2 and 3 except for the structure of its liquid depressurizing mechanism (liquid depressurizing means) 54, the same and similar components are allotted with like reference numerals and their detailed description is omitted.

As shown in FIGS. 10 to 11, liquid applicator 20 according to the seventh embodiment has liquid depressurizing mechanism 54 for depressurizing application liquid 4 inside main body 2 and is configured so that after liquid pressing mechanism 6 stops pressurizing application liquid 4, the liquid depressurizing mechanism 54 reduces the pressure on application liquid 4 to thereby draw back the application liquid in the communication path 24 into the main body 2 side.

Liquid pressing mechanism 6 and liquid depressurizing mechanism 54 comprise: a piston body (pressure applicator) 35 which moves forwards and backwards in application liquid storing space 2*b* inside main body 2 to pressurize and depressurize application liquid 4; and an action converter 55 for converting the user's rotational control over rotary actuator 31 which fronts on the outside of main body 2, into the aforementioned forward and backward movement of piston body 35.

Specifically, as shown in FIGS. 10 to 11, liquid applicator 20 according to the seventh embodiment is composed of, as essential parts, main body 2 as the outer sleeve, front barrel 3, application liquid 4, liquid pressing mechanism 6, liquid depressurizing mechanism 54, action converter 55 and cap 78, and differs in the configurations of liquid depressurizing mechanism 54 and action converter 55, from liquid applicator 1 including liquid pressing mechanism 6 only, of the first embodiment shown in FIG. 2.

In applying member 10, as shown in FIGS. 3 to 4, a front end part that is projected and exposed from the front end of front barrel 3 has a flat tapering form with tapered portions 21 and 22 on both sides thereof. The upper tapered portion 21 is formed with a step where the front end opening of communication path 24 connected to the front end of bore 10*b* is formed at its shoulder 23 as ejection opening 8. Applying portion 10*a* of applying member 10 is formed further forwards from ejection opening 8. It goes without saying that as applying member 10, those shown in FIGS. 5 to 9 can be also adopted other than those shown in FIGS. 3 to 4.

As shown in FIG. 10, in the above-described liquid applicator 20 according to the seventh embodiment the integration of liquid pressing mechanism 6 and liquid depressurizing mechanism 54 is arranged in the rear end of main body 2, and a piston body 35 of liquid pressing mechanism 6 and liquid depressurizing mechanism 54 is arranged hermetically so as to move slidably along the inner wall of the bore in the rear end of main body 2.

The liquid pressing mechanism 6 and liquid depressurizing mechanism 54 include, as essential parts, action converter 55, threaded rod 32 (pusher) and holder 34 for threaded rod 32 and the aforementioned piston body 35.

Action converter 55 is composed of an outer sleeve cap 56 and inner sleeve member (also called "advancing member") 57, which are joined so as not to be rotatable relative to each other in the usual condition and so as to rotate relative to each other by a rotational force equal to or greater than a fixed level, and the entire action converter 55 is arranged so as to be rotatable with respect to main body 2.

Detailedly, as shown in FIG. 11, inner sleeve member 57 has an approximately cylindrical form having different diameters becoming greater stepwise from its front part (57*f*) through center part (57*c*) to rear part (57*r*), with cutouts formed at different positions.

Formed in inner sleeve member 57 are a cantilevered elastic structure 58, defined by a U-shaped cutout formed on the side surface portion in the rear part, and at least, producing elasticity radially outwardly, and another cantilevered elastic structure 59, defined by a U-shaped cutout formed on the side view in the front part, and at least, producing elasticity radially outwardly.

These cantilevered elastic structures 58 and 59 have gabled roof-like projections 58*a* and 59*a* having a triangular cross-section when viewed in the axial direction, respectively, on their surfaces so that they project radially outwardly.

Formed at a position closer to the center part in the rear part of inner sleeve member 57 is a flange portion 60 which is greater stepwise in diameter than the center part and has a multiple number of annular projections on the outer periphery. The front end face of this flange portion 60 abuts the rear end face of main body 2 when the front part of inner sleeve member 57 is fitted into main body 2, so that the sleeve will not slide into main body 2 any further. When outer sleeve cap 56 has been fitted over the rear part of inner sleeve member 57, a stepped portion on the inner periphery of outer sleeve cap 56 fits on the aforementioned outer periphery of flange portion 60 in a rotatable manner so as to prevent the cap from coming off.

Formed in the rear part on the inner peripheral surface of outer sleeve cap 56 is a groove extending in the axial direction. The projection 58*a* on the aforementioned cantilevered elastic structure 58 surface becomes engaged with this groove, forming a clutch mechanism, so that inner sleeve member 57 and outer sleeve cap 56 will integrally rotate when it is operated while projection 58*a* of elastic structure 58 dislodges from the groove of outer sleeve cap 56 and starts relatively rotating when a rotational force equal to or greater than a fixed level is applied.

An engaging portion 39 formed in the front part of inner sleeve member 57 is a front center hole having an irregular cam shape corresponding to the outer peripheral shape of threaded rod 32. The aforementioned threaded rod 32 is inserted through the center hole of engaging portion 39 so that threaded rod 32 is engaged with action converter 55 (via engaging portion 39) and can slide in the axial direction but cannot relatively rotate.

Also, the outer peripheral surface other than the cutouts of threaded rod 32 that is inserted through and engaged with this engaging portion 39 is formed with a male thread, which is screwed and fitted to the female thread formed inside the center bore of holder 34.

In the embodiment the male thread and female thread are threaded right-handed, and as outer sleeve cap 56 of action converter 55 is turned clockwise with respect to main body 4, threaded rod 32 is rotated clockwise via engaging portion 39, whereby the male thread of threaded rod 32 is moved forwards by the female thread of holder 34 and pushes piston body 35, which in turn pressurizes the application liquid inside application liquid storing space (storage tank) 2*b* (liquid pressing function). Conversely, when the aforementioned outer sleeve cap 56 is rotated counterclockwise with respect to main body 4, threaded rod 32 is rotated counterclockwise via engaging portion 39, whereby the male thread of threaded rod 32 is moved backwards by the female thread of holder 34 and pulls piston body 35, which in turn depressurizes the application liquid inside application liquid storing space 2*b* (liquid depressurizing function).

It should be noted that the screw fitting portions of threaded rod 32 and holder 34 may be threaded left-handed, if required. In this case, application liquid 4 is pressurized by a counterclockwise rotation and is depressurized by a clockwise rotation, in contrast to the above case.

This holder 34 is an annular member having a roughly two-concentric cylindrical structure in which a small-diametric portion 34*b* is fixed at the front inside of a large-diametric portion 34*a*, and is attached in an unrotatable manner with its outer peripheral surface of large-diametric portion 34*a* fitted inside main body 2. A right-handed female screw thread is formed on the inner peripheral surface of small-diametric portion 34*b* of holder 34 while a meshing portion 61 made up of teethed ratchet grooves into which projection 59*a* of the aforementioned elastic structure 59 fits is formed around the whole inner surface of large-diametric portion 34*a*.

Each tooth in meshing portion 61 is so formed that one of the inward corners has a gently sloping shoulder and the other has a square shoulder, as shown in FIG. 11(*c*). With the aforementioned inner sleeve member 57 inserted into holder 34 from behind, projection 59*a* of the aforementioned elastic structure 59 fits into meshing portion 61.

As action converter 55 is turned clockwise (in the direction of arrow R in FIG. 11, in one way) with respect to main body 2, inner sleeve member 57 rotates clockwise via outer sleeve cap 56, and threaded rod 32 also rotates clockwise via engaging portion 39, so that threaded rod 32 moves forwards by screw engagement with the female thread of holder 34 to advance piston body 35 and bring the application liquid in the main body into a pressurized state.

Concerning the arrangement of action converter 55, threaded rod 32 and holder 34, as inner sleeve member 57 of action converter 55 is turned in one direction (in the rotational direction of R), projection 59*a*, while being fitted within the groove between teeth, abuts the aforementioned gently sloping shoulder and climbs over it and then falls into the next groove. Accordingly, this arrangement constitutes a pressurizing structure which allows for easy rotation with a clicking sensation.

Also concerning the arrangement of action converter 55, threaded rod 32 and holder 34, as this inner sleeve member 57 is turned in the other direction (in the rotational direction opposite to R), projection 59*a*, while being fitted within the groove between teeth, abuts the aforementioned square shoulder and should climb over it and then falls into the next groove. Accordingly, this rotation needs a greater force (torque) than that needed by the rotation in the first direction, hence this arrangement constitutes a depressurizing structure, which causes heavy load to rotate with a tight feeling.

In the above way, meshing portion 61 facilitates easy rotation of holder 34 and action converter 55 (the outer peripheral surface in the front part of inner sleeve member 57) in the first direction in a ratcheting manner and enables easy ejection when application liquid 4 is wanted to be ejected. On the other hand, when application liquid 4 is pulled in after usage the device is allowed to turn in the other direction, but this rotation is restrained so that application liquid 4 can be depressurized gently. With this configuration, it is possible to reliably prevent the application liquid from rushing out from ejection opening 8 and prevent air from being suctioned as application liquid 4 is abruptly pulled into main body 2.

Needless to say, in order to prevent quick suctioning of application liquid 4 when a rotational force equal to or greater than a fixed level is applied on action converter 55 at the time of depressurizing, a torque limiter function that releases engagement between the inner peripheral surface of the aforementioned outer sleeve cap 56 and the inner sleeve member 57 with projection 58*a* of elastic structure 58 is provided which releases the application of torque so as to make the cap inactively rotate.

FIG. 12 is a view showing a liquid pressing mechanism liquid pressing means) according to the eighth embodiment of a liquid applicator of the present invention.

Since a liquid applicator 50 shown in FIG. 12 has almost the same structure as that of the liquid applicator 1 shown in FIG. 3, the same and similar components are allotted with like reference numerals and their detailed description is omitted.

As shown in FIG. 12, a cap 51 of liquid applicator 50 is formed of a two-layered cap so as to protect the structure of front barrel 3 in a more air-tight manner.

The liquid pressing mechanism shown in FIG. 12 is constituted of a flexible and resilient application liquid storage tank (application liquid storing space) 52 that forms main body a With this hand-powered liquid pressing mechanism, application liquid 4 is pressurized in main body 2 by lightly pushing main body 2 with the fingers, so that application liquid 4 is ejected from ejection opening 8 to flat portion (temporary liquid retainer) 25 through communication path 24. Further, since the liquid can be temporarily retained by the presence of flat portion 25 even if main body 2 is more or less over-pressurized, it is possible to avoid the liquid dripping. Also, a liquid depressurizing function for depressurizing the application liquid is achieved by stopping the pressing after pressure application, so that the application liquid in communication path 24 can be pulled into the main body side.

It should be noted that the present invention is not limited to each of the above embodiments, and it goes without saying that variations can be added within the technical spirit and scope of the present invention.

Figure 13:
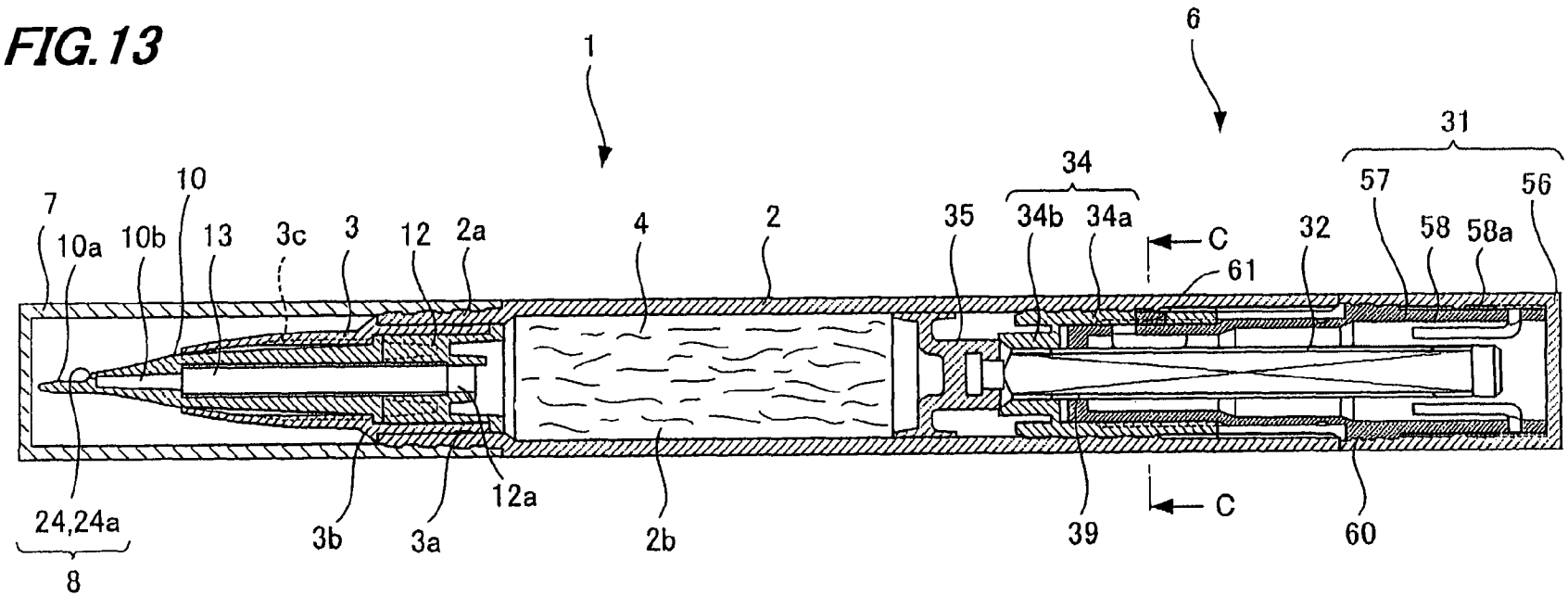
FIG. 13 is a side sectional view showing a liquid applicator according to the embodiment of the present invention.

FIG. 13 is a side sectional view of the embodiment (ninth embodiment) of a liquid applicator of the present invention.

Figure 14A:
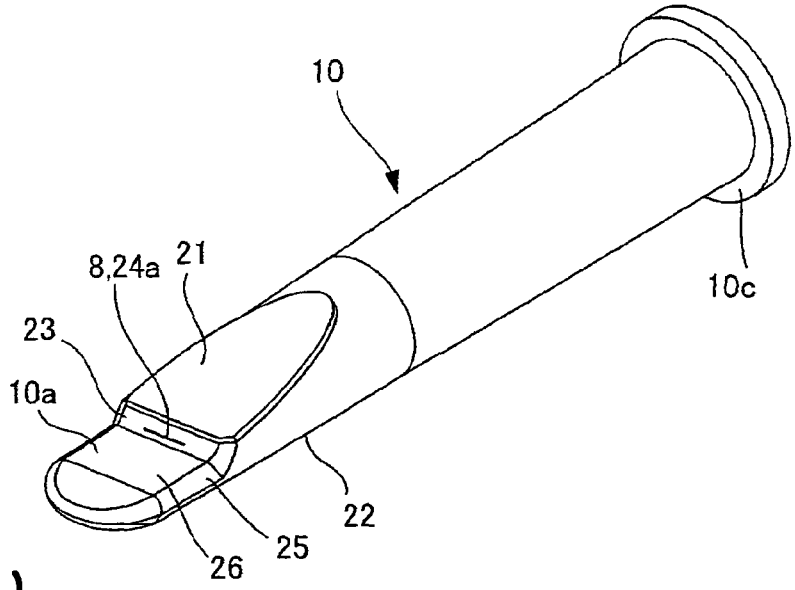
FIGS. 14(*a*) and 14(*b*) are a perspective view and vertical sectional view showing a configuration of a front barrel portion of the liquid applicator of FIG. 13.
Figure 14B:
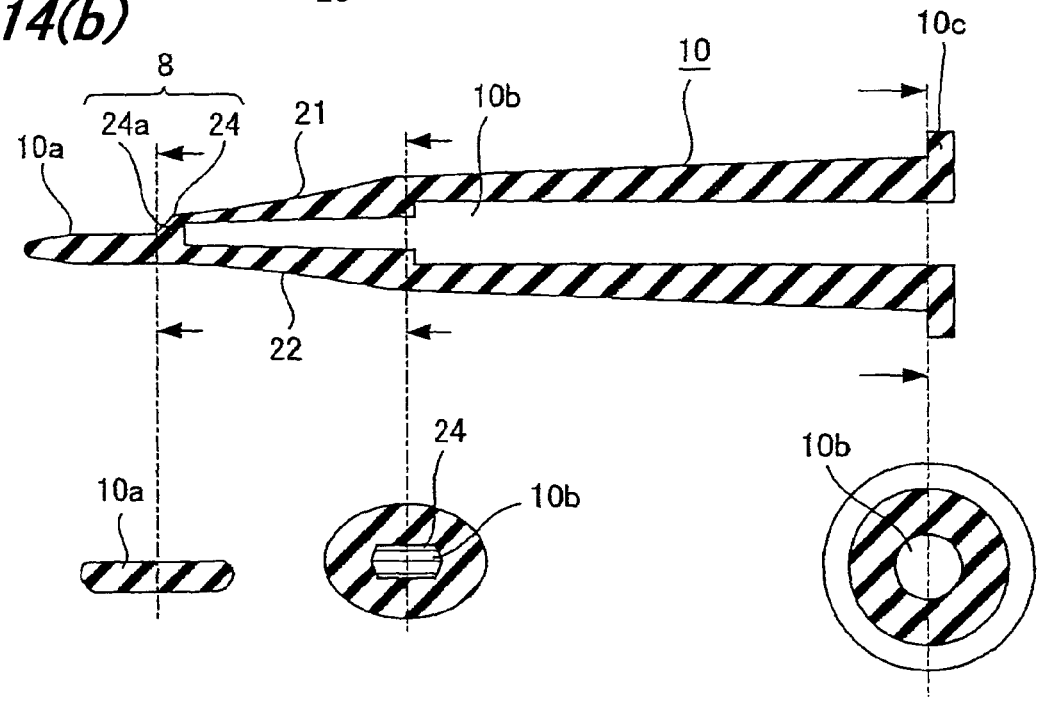

FIGS. 14(*a*) and 14(*b*) are a perspective view and vertical sectional view showing a configuration of a front barrel portion of the liquid applicator of FIG. 13.

Figure 15A:
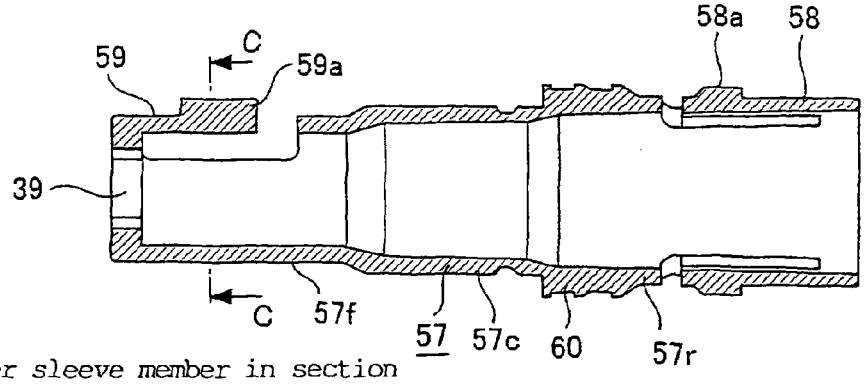
FIGS. 15(*a*), 15(*b*) and 15(*c*) are a vertical sectional view, perspective view and cross-sectional view cut along a line C-C in FIG. 13, showing an inner sleeve member of a rotary manipulator of the liquid applicator of FIG. 13.
Figure 15B:
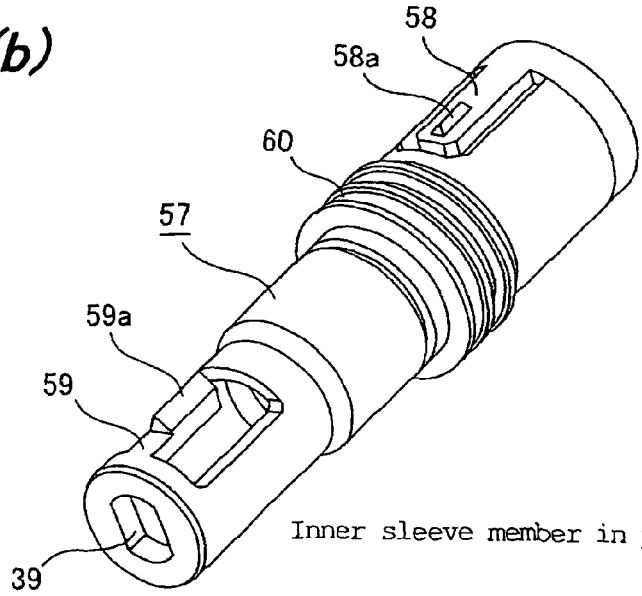
Figure 15C:
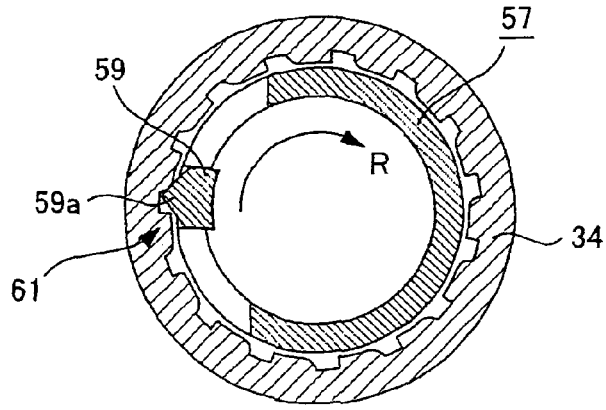

FIGS. 15(*a*), 15(*b*) and 15(*c*) are a vertical sectional view, perspective view and cross-sectional view cut along a line C-C in FIG. 13, showing an inner sleeve member of a rotary manipulator of the liquid applicator of FIG. 13.

Figure 16A:
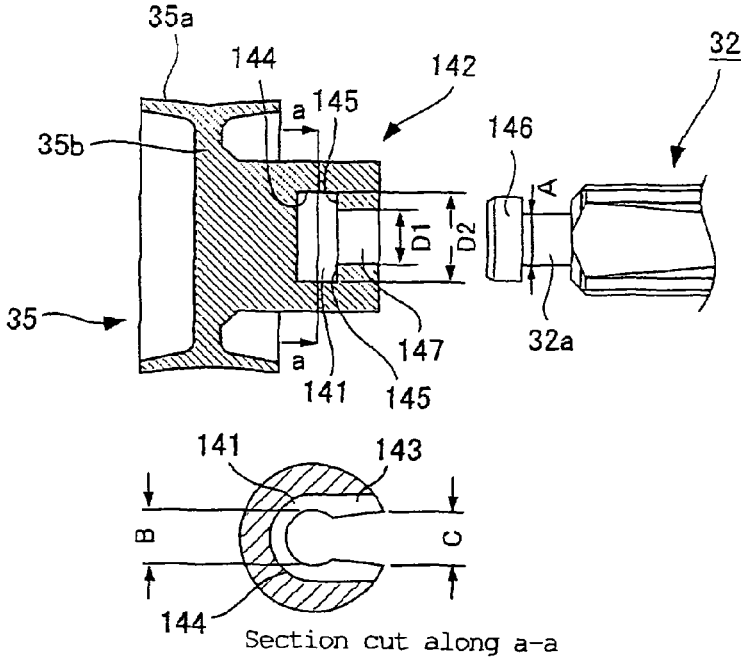
FIG. 16(*a*), 16(*b*) and 16(*c*) are a corresponding illustrative view, detailed perspective view and assembled state illustrative view of a piston body and a shaft-shaped member of the liquid applicator of FIG. 13.
Figure 16B:
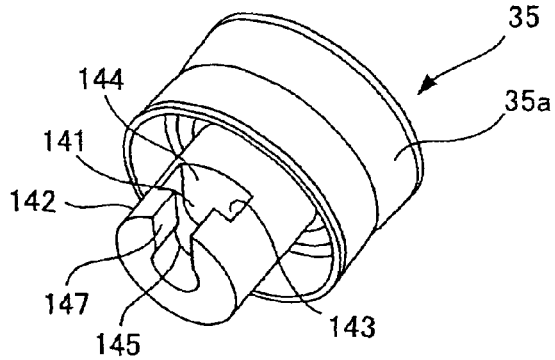
Figure 16C:
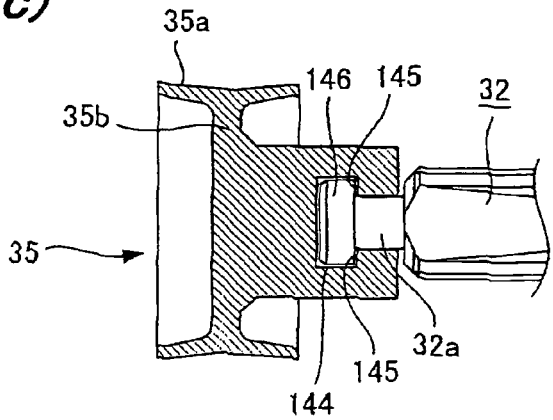

FIG. 16(*a*), 16(*b*) and 16(*c*) are correspondence illustration, detailed perspective view and assembled state illustration of a piston body and a shaft-shaped member of the liquid applicator of FIG. 13.

FIGS. 17 to 20 are vertically sectional illustrative views of the first to fourth examples, respectively, showing a piston body, fixed cylindrical member and shaft-shaped member used for a liquid applicator of the present invention.

[Liquid Applicator 1]

As shown in FIGS. 13 and 14, a liquid applicator 1 according to the embodiment is liquid applicator 1 which has an applying member 10 at the front end of a tubular main body 2 and is adapted to feed an application liquid 4 stored in a storing space (storage tank 2*b*) inside the aforementioned main body 2 to applying member 10 at the front end by pressurizing application liquid 4 by means of a liquid pressurizing/depressurizing mechanism 6 attached to the aforementioned main body and draw back application liquid 4 by depressurizing.

In this liquid applicator 1, liquid pressurizing/depressurizing mechanism 6 includes: a piston body 35 that moves forwards and backwards relative to storing space 2*b* inside the aforementioned main body 2 to decrease and increase the volume of the storing space; and a driving mechanism (constructed of a rotary actuator 31, shaft-shaped member 32, fixed cylindrical member 34, inner sleeve 57 and the like) that has shaft-shaped member (also called "threaded rod") 32 whose front part is engaged with the rear part of the piston body 35 so as to allow user to apply actuating force to drive shaft-shaped member 32 forwards and backwards to thereby move the aforementioned piston body 35 forwards and backwards.

Detailedly, as shown in FIG. 13, liquid applicator 1 includes, as its essential parts, main body 2 as the outer sleeve, a front barrel 3, application liquid 4, liquid pressurizing/depressurizing mechanism 6, a cap 7 and an ejection opening 8. As to each part, applying member 10 is molded of elastic resin such as rubber or the like so as to provide necessary application performance while the components other than applying member 10 are molded of resin with such density and rigidity as to provide necessary airtight performance and supporting performance,

[Main Body 2]

Main body 2 has a roughly tubular hollow configuration with its front end part formed with a tapering small-diametric portion 2*a*. The outside diameter of small-diametric portion 2*a* is formed to be approximately equal to the inside diameter of cap 7. Cap 7 is detachably fitted to the small-diametric portion 2*a* in a detachable manner. Small-diametric portion 2*a* and cap 7 are formed with rib-like indentations and projections on their areas to be presumed to oppose each other when they are fitted, so that their indentations and projections mesh each other to thereby prevent cap 7 from coming off small-diametric portion 2*a* by accidental force.

A proximal end of front barrel 3 is fluid-tightly fitted inside the bore of small-diametric portion 2*a* of main body 2. Liquid pressurizing/depressurizing mechanism 6 is arranged at the rear end of main body 2.

Piston body (gasket) 35 of this liquid pressurizing/depressurizing mechanism 6 is inserted from the rear opening of main body 2 and arranged hermetically and movably along the inner wall in the middle part of the main body.

Accordingly, the spatial portion enclosed by the main body 2 interior, the rear end part of front barrel 3 and piston body 35 constitutes an application liquid storing space 2*b* of application liquid 4.

[Liquid Pressurizing/Depressurizing Mechanism 6]

As shown in FIG. 13, in liquid applicator 1 according to the embodiment, the integrated liquid pressurizing/depressurizing mechanism 6 is arranged at the rear end of main body 2. Liquid pressurizing/depressurizing mechanism 6 is constructed so as to fluid-tightly slide piston body 35 as its constituent along the inner wall in the middle part of main body 2 by user's actuating input, whereby the volume of the aforementioned application liquid storing space 2*b* is reduced or increased to pressurize or depressurize application liquid 4.

Liquid pressurizing/depressurizing mechanism 6 is composed of, as its essential parts, a rotary actuator 31, shaft-shaped member 32, fixed cylindrical member 34 for causing shaft-shaped member 32 to advance and retract (these correspond to the driving mechanism), and the aforementioned piston body 35.

Rotary actuator 31 is formed of an outer sleeve cap 56 and an inner sleeve member 57, being joined to each other in an unrotatable manner, and rotary actuator 31 as a whole is arranged rotatably in main body 2.

[Fixed Cylindrical Member 34]

Fixed cylindrical member 34 is an annular member and unrotatably attached to main body 2. Formed in the meshing portion 61 between fixed cylindrical member 34 and rotary actuator 31 (the outer peripheral surface in the front part of inner sleeve member 57) is a ratchet (see FIG. 13). Rotary actuator 31 is arranged to be rotatable in both directions with respect to fixed cylindrical member 34 (main body 2 fixed to it) so that it will eject the application liquid while making the fingers feel a clicking sensation by the ratchet when the actuator is rotated in one direction that causes ejection of the application liquid. When the actuator is rotated in the other direction, it is restricted from rotating so that it can rotate only when an input equal to or greater than a designated torque is applied. In other words, the actuator provides a torque limiter function that releases its constraint when a torque equal to or above a fixed level is applied in the other direction.

[Applying Member 10]

Applying member 10 of liquid applicator 1 is made of an elastic body. As shown in FIGS. 13 to 14, applying member 10 includes: a valve structure 8 which is formed with a communication path 24 for communication between the inside and outside of main body 2 and can close the communication path 24 in the normal condition (in a state where the application liquid is not pressurized) and open communication path 24 by its elastic deformation when application liquid 4 is pressurized by liquid pressurizing/depressurizing mechanism 6, and the applying portion 10*a* of applying member 10 is formed projected further forward from an ejection opening 24*a* of communication path 24 of valve structure 8.

As shown in FIGS. 13 and 14, applying member 10 is constructed such that its front end part that is projected and exposed from the front of front barrel 3 has a flat tapering structure with tapered portions 21 and 22 formed on both sides thereof. The upper tapered portion 21 is formed with a step, where a valve structure 8 of slit-like communication path 24 that is connected to a bore 10*b* is formed at its shoulder 23. Applying portion 10*a* of applying member 10 is formed further forward from valve structure 8.

Further, owing to the function of depressurizing application liquid 4 inside main body 2 by liquid pressurizing/depressurizing mechanism 6, valve structure 8 is adapted to forcibly return the elastic deformation of communication path 24 into the normal state to close the communication path 24 as the liquid pressurizing/depressurizing mechanism 6 depressurizes application liquid 4 after liquid pressurizing/depressurizing mechanism 6 stops pressurizing application liquid 4.

[Rotary Actuator 31 and Inner Sleeve Member 57]

Rotary actuator 31 is composed of an outer sleeve cap 56 and inner sleeve member (also called "advancing member") 57, which are joined so as not to be rotatable relative to each other in the usual condition and so as to rotate relative to each other by a rotational force equal to or greater than a fixed level, and the entire rotary actuator 31 is arranged so as to be rotatable with respect to main body 2.

Detailedly, as shown in FIG. 15, inner sleeve member 57 has an approximately cylindrical form having different diameters becoming greater stepwise from its front part (57*f*) through center part (57*c*) to rear part (57*r*), with cutouts formed at different positions.

Formed in inner sleeve member 57 are a cantilevered elastic structure 58, defined by a U-shaped cutout formed on the side surface portion in the rear part (57*r*), and at least, producing elasticity radially outwardly, and another cantilevered elastic structure 59, defined by a U-shaped cutout formed on the side view in the front part (57*f*), and at least, producing elasticity radially outwardly.

These cantilevered elastic structures 58 and 59 have gabled roof-like projections 58*a* and 59*a* having a triangular cross-section when viewed in the axial direction, respectively, on their surfaces so that they project radially outwardly.

Formed at a position closer to the center part in the rear part (57*c*) of inner sleeve member 57 is a flange portion 60 which is greater stepwise in diameter than the center part and has a multiple number of annular projections projected outwards. The front end face of this flange portion 60 abuts the rear end face of main body 2 when the front part of inner sleeve member 57 is fitted into main body 2, so that inner sleeve member 57 will not slide into main body 2 any further. When outer sleeve cap 56 has been fitted over the rear part of inner sleeve member 57, a stepped portion on the inner periphery of outer sleeve cap 56 fits on the aforementioned outer periphery of flange portion 60 in a rotatable manner so as to prevent the cap from coming off.

Formed in the rear part on the inner peripheral surface of outer sleeve cap 56 is a groove extending in the axial direction. The projection 58*a* on the aforementioned cantilevered elastic structure 58 surface becomes engaged with this groove, forming a clutch mechanism, so that inner sleeve member 57 and outer sleeve cap 56 will integrally rotate when it is operated while projection 58*a* of elastic structure 58 dislodges from the groove of outer sleeve cap 56 and starts relatively rotating when a rotational force equal to or greater than a fixed level is applied.

An inner cam portion (engaging portion) 39 formed in the front part of inner sleeve member 57 is a front center hole having an irregular cam shape corresponding to the outer peripheral shape of shaft-shaped member 32. The aforementioned shaft-shaped member 32 is inserted through the hole (center hole) of inner cam portion 39 so that shaft-shaped member 32 is engaged with rotary actuator 31 (via inner cam portion 39) and can slide in the axial direction but cannot relatively rotate.

Also, the outer peripheral surface other than the cutouts of shaft-shaped member 32 that is inserted through and engaged with this inner cam portion 39 is formed with a male thread, which is screwed and fitted to a female thread formed inside the center bore of fixed cylindrical member 34.

In the embodiment the male thread and female thread are threaded right-handed, and as outer sleeve cap 56 of rotary actuator 31 is turned clockwise with respect to main body 2, shaft-shaped member 32 is rotated clockwise via inner cam portion 39, whereby the male thread of shaft-shaped member 32 is moved forwards by the female thread of fixed cylindrical member 34 and pushes piston body 35, which in turn pressurizes the application liquid inside application liquid storing space (storage tank) 2*b* (liquid pressing function).

Conversely, when the aforementioned outer sleeve cap 56 is rotated counterclockwise with respect to main body 2, shaft-shaped member 32 is rotated counterclockwise via inner cam portion 39, whereby the male thread of shaft-shaped member 32 is moved backwards by the female thread of fixed cylindrical member 34 and pulls piston body 35, which in turn depressurizes the application liquid inside application liquid storing space 2*b* (liquid depressurizing function).

In this way, liquid pressurizing/depressurizing mechanism 6 achieves the liquid pressurizing and depressurizing function for application liquid 4.

It should be noted that the screw fitting portions of shaft-shaped member 32 and fixed cylindrical member 34 may be threaded left-handed, if required. In this case, application liquid 4 is pressurized by a counterclockwise rotation and is depressurized by a clockwise rotation, in contrast to the above case.

This fixed cylindrical member 34 is an annular member having a roughly two-concentric cylindrical structure in which a small-diametric portion 34*b* is integrated (or fixed) at the front inside of a large-diametric portion 34*a*, and is attached in an unrotatable manner with its outer peripheral surface of large-diametric portion 34*a* fitted inside main body 2 (see FIG. 13). A right-handed female screw thread is formed on the inner peripheral surface of small-diametric portion 34*b* of fixed cylindrical member 34 while a meshing portion 61 made up of teethed ratchet grooves into which projection 59*a* of the aforementioned elastic structure 59 fits is formed around the whole inner surface of large-diametric portion 34*a*.

Each tooth in meshing portion 61 is so formed that one of the inward corners has a gently sloping shoulder and the other has a square shoulder, as shown in FIG. 15(*c*). With the aforementioned inner sleeve member 57 inserted into fixed cylindrical member 34 from behind, projection 59*a* of the aforementioned elastic structure 59 fits into meshing portion 61.

As rotary actuator 31 is turned clockwise (in the direction of arrow R in FIG. 15, in one way) with respect to main body 2, inner sleeve member 57 rotates clockwise via outer sleeve cap 56, and shaft-shaped member 32 also rotates clockwise via inner cam portion 39, so that shaft-shaped member 32 moves forwards by screw engagement with the female thread of fixed cylindrical member 34 to advance piston body 35 and bring the application liquid in the main body into a pressurized state.

Concerning the arrangement of rotary actuator 31, shaft-shaped member 32 and fixed cylindrical member 34, as inner sleeve member 57 of rotary actuator 31 is turned in one direction (in the rotational direction of R), projection 59*a*, while being fitted within the groove between teeth, abuts the aforementioned gently sloping shoulder and climbs over it and then falls into the next groove. Accordingly, this arrangement constitutes a pressurizing structure which allows for easy rotation with a clicking sensation. Also concerning the arrangement of rotary actuator 31, shaft-shaped member 32 and fixed cylindrical member 34, as this inner sleeve member 57 is turned in the other direction (in the rotational direction opposite to R), projection 59*a*, while being fitted within the groove between teeth, abuts the aforementioned square shoulder and should climb over it and then falls into the next groove. Accordingly, this rotation needs a greater force (torque) than that needed by the rotation in the first direction, hence this arrangement constitutes a depressurizing structure, which causes heavy load to rotate with a tight feeling.

In the above way, meshing portion 61 facilitates easy rotation of fixed cylindrical member 34 and rotary actuator 31 (the outer peripheral surface in the front part of inner sleeve member 57) in the first direction in a ratcheting manner when application liquid 4 is wanted to be ejected so as to facilitate easy ejection. On the other hand, when application liquid 4 is pulled in after usage the device is turned in the other direction so as to close the slit of valve structure 8 by force; however this rotation is restrained and adapted to need much effort so that application liquid 4 can be depressurized gently. With this configuration, it is possible to reliably prevent valve structure 8 at the ejection opening from closing quickly more than needed and prevent air from being suctioned as application liquid 4 is abruptly pulled into main body 2.

Needless to say, in order to prevent quick suctioning of application liquid 4 when a rotational force equal to or greater than a fixed level is applied on rotary actuator 31 at the time of depressurizing, a torque limiter function that releases engagement between the inner peripheral surface of the aforementioned outer sleeve cap 56 and the inner sleeve member 57 with projection 59*a* of elastic structure 59 is provided which releases the application of torque so as to make the cap inactively rotate.

[Shaft-Shaped Member 32]

Shaft-shaped member 32 has recessed grooves and a male thread formed on its peripheral surface portion along its axial direction, assuming an irregular cam shape in section (e.g., having an approximately oval shape by forming cutouts at both sides with respect to the diameter when viewed cross-sectionally). The male thread is screwed and fitted into the female thread formed inside the center bore of fixing cylindrical member 34.

An inner cam portion 39 (at a further front part of meshing portion 61) of inner sleeve member 57 of rotary actuator 31 has a cam bore (center bore) whose inside shape has an irregular cam shape having projections corresponding to the recessed grooves of the circumferential shape of shaft-shaped member 32.

The aforementioned shaft-shaped member 32 is inserted to pass through the cam bore (center bore) of inner cam portion 39, whereby shaft-shaped member 32 is engaged with rotary actuator 31 (by way of inner cam portion 39) so as to be able to slide in the axial direction in a relatively unrotatable manner.

The front end of shaft-shaped member 32 is connected to piston body 35. As rotary actuator 31 turns in the predetermined direction, shaft-shaped member 32 advances by the means of fixed cylindrical member 34 toward the front end of main body 2, so as to cause piston body 35 to move forwards and press application liquid 4.

[Piston Body 35]

Referring to FIG. 16, a specific configuration and state of engagement of piston body 35 and shaft-shaped member 32 will be described.

As shown in FIGS. 16(*a*) to 16(*b*), piston body 35 is constructed of an approximately cylindrical gasket part 35*a* that has an outer peripheral side narrower in the middle with respect to the axial direction and is arranged slidably against the inner peripheral surface of the application liquid storing chamber (application liquid storing space 2*b*) of the aforementioned main body 2, a thick-walled base part 35*b* formed inwards in center or toward the axis of gasket part 35*a* and an engaging portion 142 that is extended rearwards from the base part 35*b* in an approximately column-like fashion, and is integrally formed of resin by injection molding.

In the rear of the aforementioned piston body 35, engaging portion 142 having a large interior space 141 that opens rearwards is projected to the rear in an approximately cylindrical fashion.

An insert hole 143 that opens the interior space 141 sidewards is formed on part of the side surface portion of the projected engaging portion 142 in such a manner that, as to the distance between the opposing surfaces of an inner wall portion 144 that defines the aforementioned interior space 141, the opposing distance D2 on the front side is greater than the opposing distance D1 on the rear side with a stepped portion 145 in between.

An engaging projected portion 146 that is projected sidewards in a flange-like fashion with respect to the axial direction is integrally formed at the front end of the shaft-shaped member 32 with a cylindrical part 32*a* having no recessed groove and no male thread, in between.

As shown in FIG. 16(*c*), the front end part of the shaft-shaped member 32 is positioned inside interior space 141 through insert hole 143, so that the engaging projected portion 146 is hooked on the front side of stepped portion 145 in inner wall portion 144, whereby the front part of shaft-shaped member 32 is engaged with engaging portion 142 in the rear part of the piston body 35. The inside diameter of interior space 141 is set equal to or marginally greater than the outside diameter of engaging projected portion 146.

In this way, the front end part of the shaft-shaped member 32 can be positioned inside interior space 141 by passing it through insert hole 143. Accordingly, it is possible to pass engaging projected portion 146 at the front end of shaft-shaped member 32 through insert hole 143 without any resistance when it is set in interior space 141. Since it is no longer necessary to fit the engaging projected portion in a squeezing manner as conventionally done, it is possible to designate the height of engaging projected portion 146 and stepped portion 145 freely depending on the engaging force required.

Further, since it is possible to engage the front part of shaft-shaped member 32 with the rear part of the piston body 35 with an engaging force that can be set freely when the engaging projected portion 146 is hooked on stepped portion 145 of inner wall portion 144, engaging projected portion 146 is hooked on and engaged securely with stepped portion 145 of inner wall portion 144 when shaft-shaped member 32 is retracted.

Also, engaging portion 142 is also formed with a leading slot 147 through which cylindrical part 32*a* of the shaft-shaped member 32 is inserted, as shown in FIG. 16(*a*). When viewed cross-sectionally, the base part of this leading slot 147 has a circular sectional shape, part of which is cut away. The width B at the cutaway portion is designed to be smaller than the entrance width C (B<C).

It is also preferred that the diameter of the base part of leading slot 147 is set equal to or marginally smaller than the outside diameter A of cylindrical part 32*a* of the shaft-shaped member 32 in view of achieving attachment without looseness.

It is also preferred that the aforementioned width B at the cutaway portion is set equal to or smaller than the aforementioned outside diameter A in order to prevent cylindrical part 32*a* hence shaft-shaped member 32 from dislodging. When these parts are resin moldings, leading slot 147 can be deformed or spread by pushing in for attachment.

Further, it is preferred from a workability viewpoint that the entrance with C is set greater than the width B at the aforementioned portion so as to easily lead cylindrical part 32*a*.

Engaging portion 142 in the rear part of the piston body 35 is formed with inner wall portion 144 and stepped portion 145 so that it, ranging from insert hole 143 to interior space 141, assumes an approximately T-shaped configuration when viewed from the side. Further, since engaging projected portion 146 at the front end of shaft-shaped member 32 is formed in a flange shape whose width corresponds to the dimension of the interior space 141, the shaft-shaped member can be hooked on stepped portion 145 making use of approximately the whole circumference of the flange, so that it can be engaged with its left and right sides in balance compared to the case where no flange shape is formed. Accordingly, it is possible to engage the front end part of shaft-shaped member 32 with engaging portion 142 securely with improved strength compared to a case where it is hooked only on one side of the flange.

Here, since the engaging projected portion 146 and cylindrical part 32*a* of shaft-shaped member 32 of this embodiment transmit thrusting and drawing forces to piston body 35 while they are being rotated within the aforementioned interior space 141 and leading slot 147 when liquid applicator 1 is used, they form a rotationally symmetrical structure having circular sections. The present invention, however, should not be limited to this. When a configuration in which the cam bore of the inner cam portion in the inner sleeve member is replaced by a threaded bore and the female thread of the center bore of the fixed cylindrical member is replaced by a cam bore is adopted in order to drive the shaft-shaped member forwards and rearwards, it is possible to transmit thrusting and drawing forces to the piston body without rotating the shaft-shaped member. This adoption of a non-rotational shaft-shaped member configuration makes the usage of a rotationally symmetrical structure for the front end part of the shaft-shaped member unnecessary, it is hence possible to adopt various asymmetrical configurations which can improve the engaging force with the piston body, whereby it is possible to improve the design flexibility of the liquid applicator.

Figure 17:
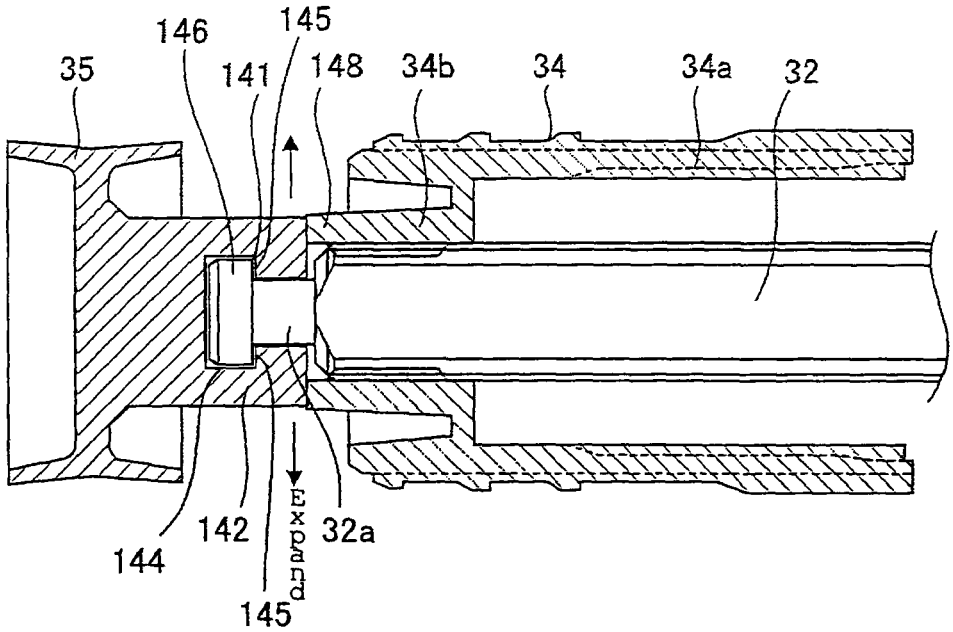
FIG. 17 is a vertically sectional illustrative view showing the first example of a piston body, fixed cylindrical member and shaft-shaped member used for a liquid applicator of the present invention.

Now, FIG. 17 shows fixed cylindrical member 34 of the liquid applicator of the first example.

As shown in FIG. 17, in this first example, fixed cylindrical member 34 in which the bore (center bore) through which shaft-shaped member 32 is projected and retracted is formed in small-diametric portion 34*b* at the front part, at its front end on the side of application liquid storing space 2*b* and piston body 35, is fixed to the main body. Other configurations and functions are the same as those of the liquid applicator of the above embodiment shown in FIGS. 13 to 16, so that the similar components are allotted with the like reference numerals.

An annular projection 148 that is cylindrically projected forwards around the aforementioned bore is formed in the front end part of the fixed cylindrical member 34. This annular projection 148 is formed in such a size that the rear end face of engaging portion 142 of piston body 35 will collide with it.

If a rotational force is further applied to the aforementioned rotary actuator 31 after this collision, shaft-shaped member 32 tends to be pulled further. In this case, though interior space 141 may be deformed and expanded as annular projection 148 abuts engaging portion 142 and engaging projected portion 146 pulls stepped portion 145, it is possible to suppress this expanding force from acting because engaging projected portion 146 and stepped portion 145 are formed flat.

Other configurational examples of fixed cylindrical member 34 will be described later.

[Front Barrel 3]

As shown in FIG. 13, front barrel 3 has a tapering tubular structure which is reduced in diameter as it goes toward the front end, and holds applying member 10 in its interior space that opens at its front and rear sides, with the front end of applying member 10 sticking out. This front barrel is fixed to main body 2 as it holds the applying member. As will be described later, applying member 10 has a shape which becomes narrower and flatter as it goes toward the front.

An annular fitting recess 3*a* is formed around the outer periphery in the rear end part of front barrel 3. Fitting recess 3*a* is press fitted with an annular fitting projection (not shown) formed on the inner surface of small-diametric portion 2*a* of main body 2 so as to prevent front barrel 3 from coming off main body 2.

Formed also on the outer periphery of front barrel 3 is flange 3*b*, which abuts the front end face of small-diametric portion 2*a*. A plurality of ribs 3*c* projected extending in the axial direction are formed equi-distantly on the inner peripheral surface of this front barrel 3. The rear end faces of these ribs 3*c* and the front end face of a pipe joint 12 sandwich the flanged portion that is enlarged in diameter at the rear part of applying member 10 so as to hold and fix applying member 10 inside front barrel 3.

Applying member 10 is formed of an elastic member and is supported by pipe joint 12 and an application liquid feed pipe 13. Application liquid feed pipe 13 is inserted and fixed in a passage hole 12*a* at the center of pipe joint 12 and is inserted into a bore 10*b* provided for applying member 10, from its rear end up to the middle part (front end of front barrel 3) where the bore is enlarged in diameter, to also serve as a liquid leakage preventing function.

Applying member 10 has a flat tapering structure with tapered portions 21 and 22 formed on both sides thereof. The upper tapered portion 21 is formed with a step, where a valve structure 8 is formed at its shoulder 23. Applying portion 10*a* of applying member 10 is formed further forwards from valve structure 8.

Valve structure 8 has a simple structure making use of communication path 24 formed slit-like at shoulder 23 and the elastic deformation of applying portion 10*a*. Communication path 24 is connected to bore 10*b* of applying member 10 and is closed by its elasticity in the normal condition so that application liquid 4 will not flow out. On the other hand, when application liquid 4 is pressurized by liquid pressurizing/depressurizing mechanism 6, it is opened by virtue of elastic deformation.

In the present invention, applying member 10 may be totally formed of elastic material, or applying portion 10*a* alone may be formed of elastic material. The material for applying portion 10*a* is an elastic material, examples of elastic material including rubber, elastomer etc. Further, as the material for applying portion 10*a*, for example, elastic material having no continuous foam may be used without problems as long as it presents fluid-tightness.

(1) Examples of rubber include NBR, silicone rubber, EPDM, fluorosilicone rubber, fluororubber, urethane rubber, natural rubber, ohlorobrene rubber, butadiene rubber, butyl rubber and the like.

(2) Examples of elastomer include styrene elastomer, vinyl chloride elastomer, olefin elastomer, polyester elastomer, polyamide elastomer, urethane elastomer and the like.

(3) Examples of closed cell foam include polyethylene foam, vinyl chloride foam, polystyrene foam and the like.

As shown in FIG. 14, applying portion 10*a* is a part that is extended from shoulder 23 formed as a step and is formed as a flat portion 25, which is formed with a roughened surface portion 26. Application liquid 4 ejected from ejection opening 24*a* of communication path 24 is temporarily retained on roughened surface portion 26 of flat portion 25. The retained amount of the application liquid on it depends on the type of the cosmetic used.

In the thus configured liquid applicator 1, in the normal condition the interior of main body 2, the interior of pipe joint 12 of front barrel 3, the interior of application liquid feed pipe 13 and bore 10*b* of applying member 10 are filled with application liquid 4. The charged application liquid 4 will not be in contact with the external air because communication path 24 is in a closed state. Upon usage, rotary actuator 31 of liquid pressurizing/depressurizing mechanism 6 is turned. As rotary actuator 31 is rotated, shaft-shaped member 32 advances toward the front end by drive transmission through inner cam portion 39. This causes piston element 35 to move forwards and pressurize application liquid 4. As application liquid 4 is pressurized, communication path 24 of valve structure 8 is opened opposing the elastic force. This causes a predetermined amount of application liquid 4 to be ejected so that the pressure of application liquid 4 is reduced to approximately the atmospheric pressure and hence communication path 24 is closed.

Also, since liquid pressurizing/depressurizing mechanism 6 uses a ratchet, it has a function of permitting rotary actuator 31 to rotate a predetermined amount only by a single action of rotary actuator 31 while pushing out piston body 35 by a predetermined distance every actuation.

Further, provision of flat portion (liquid retainer) 25 for temporarily holding the ejected application liquid 4 in applying portion 10*a* near ejection opening 24*a* of communication path 24, makes it possible to prevent the ejected application liquid 4 from dripping even if the liquid abruptly rushes out.

As understood from the above, the application liquid 4 that comes in contact with the external air after usage is limited to that residing in applying portion 10*a* from ejection opening 24*a*, which can be easily removed. As a result, it is not only possible to apply application liquid 4 easily even though it is high in viscosity, but also fully protect the stored application liquid 4 against the contamination by microbes and the like from the external air and outside environment.

Here, it goes without saying that the present invention is not limited to the configurations of the liquid applicators of the above embodiments, various modifications can be added within the scope of the invention.

For example, in the liquid applicator of the above embodiment, the engagement between piston part 35 and the shaft-shaped member is secured using the piston body 35 shown in FIG. 16, the fixed cylindrical member 34 according to example 1 shown in FIG. 17, and deformation of engaging portion 142 to expand interior space 141 is prevented by forming engaging projected portion 146 and stepped portion 145 to be flat. However, in order to prevent this engaging portion 142 from being deformed in a more efficient manner, it is further preferable that fixed cylindrical member 34 adopts the following structures of the second to fourth examples.

Figure 18:
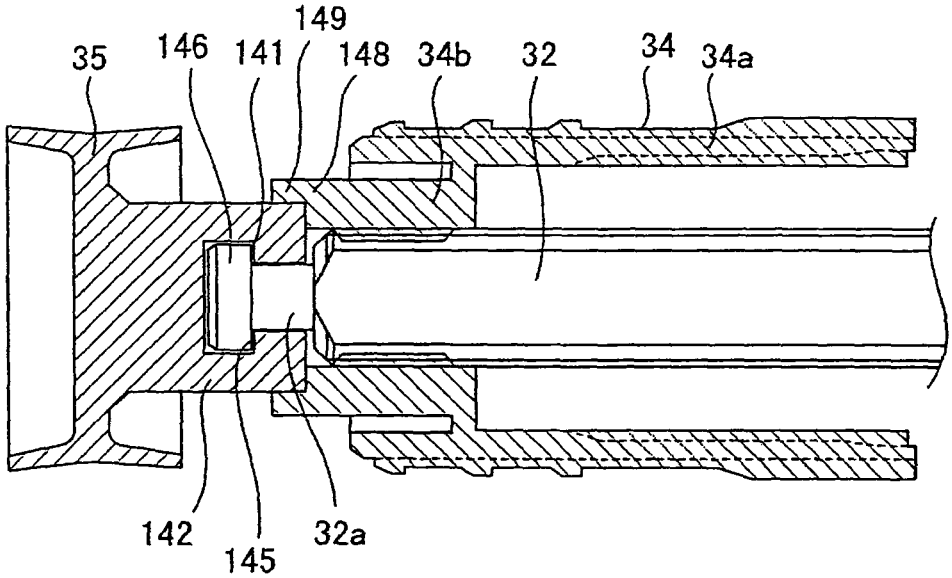
FIG. 18 is a vertically sectional illustrative view showing the second example of a piston body, fixed cylindrical member and shaft-shaped member used for a liquid applicator of the present invention.

FIG. 18 is a fixed cylindrical member 34 of a liquid applicator according to the second example.

As shown in FIG. 18, the liquid applicator according to the second example, annular projection 148 as the front end part of fixed cylindrical member 34 is projectively formed with a stepped large-diametric hollow cylinder. The inside diameter of the projected large-diametric front end part 149 is formed to be marginally greater than the outside diameter of the rear end part of engaging portion 142 of the piston body 35. Since other configurations are the same as those of the liquid applicator of the above embodiment shown in FIGS. 13 to 16, the similar components are allotted with the like reference numerals.

When piston body 35 is retracted to the limit, the rear end part of engaging portion 142 of piston body 35 fits into the inside of annular projection 148. If shaft-shaped member 32 is moved further to the rear by the driving mechanism, engaging projection 146 at the front end of shaft-shaped member 32 exerts force that tends to deform engaging portion 142 of piston body 35 to expand interior space 141 that is connected to insert hole 143. However, the rear end part of this engaging portion 142 is fitted into the inside of the aforementioned annular projection 148 so that it is possible to prevent deformation because annular projection 148 exerts force against deformation from the outside.

Accordingly, no malfunctions such as displacement of engaging projected portion 146 of shaft-shaped member 32 from engaging portion 142 of piston body 35 and the like will occur.

Here, when annular projection 148 is constructed such that the inside diameter of, at least, the front end is formed to be greater by 0.1 to 2 mm (preferably, greater to some extent such that the engaging portion fits in marginally closely) than the outside diameter of the rear end part of engaging portion 142 of the piston body 35, it is possible to make engaging portion 142 smoothly fit into annular projection 148 and it is possible to quickly exert anti-deformation effect on engaging portion 142 because the inner periphery of annular projection 148 abuts engaging portion 142 as soon as it is about to deform.

Figure 19:
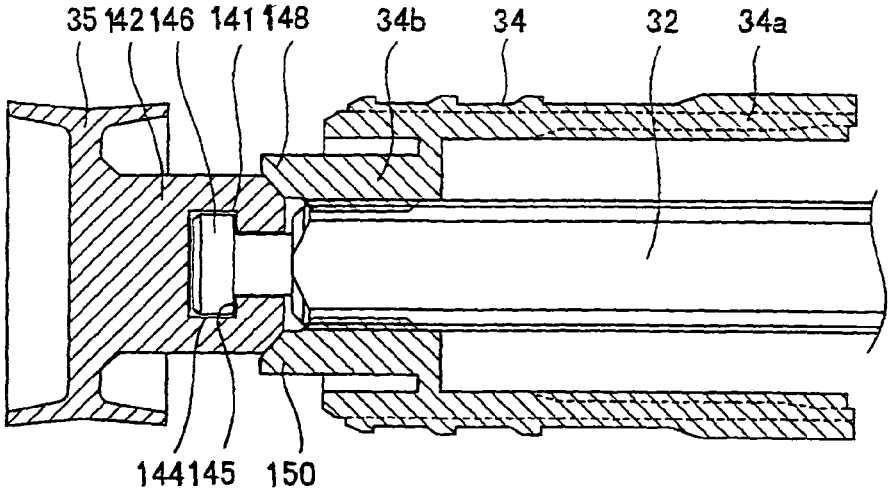
FIG. 19 is a vertically sectional illustrative view showing the third example of a piston body, fixed cylindrical member and shaft-shaped member used for a liquid applicator of the present invention.

FIG. 19 is a fixed cylindrical member 34 of a liquid applicator according to the third example.

As shown in FIG. 19, the liquid applicator according to the third example, the inner peripheral surface of annular projection 148 as the front end part of fixed cylindrical member 34 and the outer peripheral surface of the rear end part of engaging portion 142 of the piston body 35 are tapered reducing their diameter narrower toward the rear. Since other configurations are the same as those of the liquid applicator of the above embodiment shown in FIGS. 13 to 16, the similar components are allotted with the like reference numerals.

Detailedly, annular projection 148 as the front end part of fixed cylindrical member 34 is tapered, increasing its diameter toward the front so that the enlarged inside diameter at the front end of front end part 150 that is projected becoming thicker is formed to be greater than the outside diameter at the rear end of engaging portion 142 of the piston body 35 that is tapered toward the rear.

Since other configurations are the same as those of the liquid applicator of the above embodiment shown in FIGS. 13 to 16, the similar components are allotted with like reference numerals and their detailed description is omitted.

According to the third example, when piston body 35 is retracted to the limit, the rear end part of engaging portion 142 of piston body 35 fits into the inside of annular projection 148. In this case, the rear end of engaging portion 142 that is tapered toward the rear fits into the front end of annular projection 148 whilst the former is being positioned by the latter. Accordingly, if the center axis of each part is more or less positioned off the other, once the engaging portion begins entering the entrance side of annular projection 148, the engaging portion 142 can fit in whilst its axis is being automatically aligned with the other. Then, when engaging portion 142 has been fitted inside annular projection 148, if shaft-shaped member 32 is moved further to the rear by the driving mechanism, engaging projection 146 at the front end of shaft-shaped member 32 receives a force of gradually making its diameter smaller from the tapered inner peripheral surface of the aforementioned annular projection 148. Accordingly, the force tending to deform engaging portion 142 of piston body 35 so as to expand interior space 141 when shaft-shaped member 32 is pulled can be countered more strongly by the force that annular projection 148 exerts to prevent deformation from the outside, hence it is possible to further reliably prevent deformation.

Figure 20:
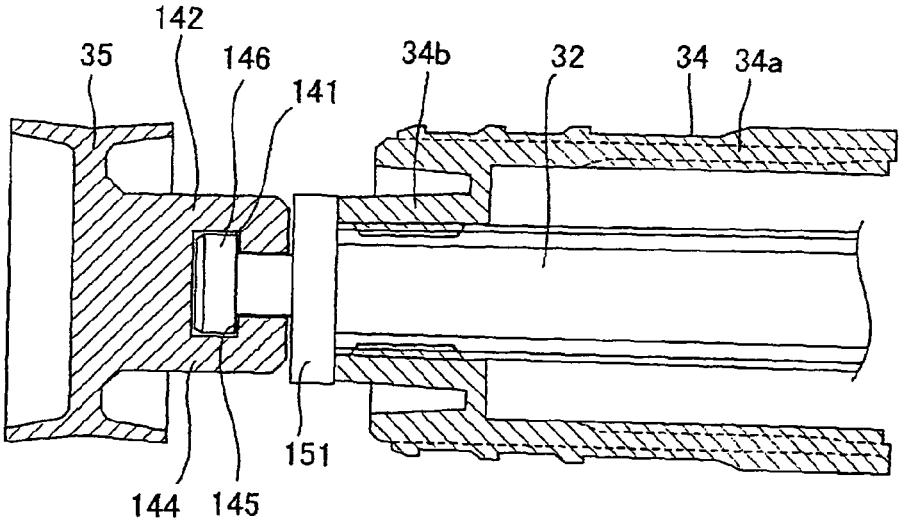
FIG. 20 is a vertically sectional illustrative view showing the fourth example of a piston body, fixed cylindrical member and shaft-shaped member used for a liquid applicator of the present invention.

FIG. 20 shows a shaft-shaped member 32 and fixed cylindrical member 34 of a liquid applicator according to the fourth example.

As shown in FIG. 20, in the liquid applicator of the fourth embodiment, a fixed cylindrical member 34 in which a bore (center bore) through which a shaft-shaped member 32 is projected and retracted is formed in the front end part on the side of the aforementioned storing space 2*b* and piston body 35, is fixed to the main body 2. Other configurations are the same as those of the liquid applicator of the above embodiment shown in FIGS. 13 to 16, so that the similar components are allotted with the like reference numerals.

In the shaft-shaped member 32 a flange-like large-diametric portion 151 whose diameter is enlarged sideward is formed in the rear of engaging projected portion 146 that engages engaging portion 142 in the rear part of piston body 35, so that when the piston body 35 is retracted, this large-diametric portion 151 abuts the front end face of annular projection 148 located around the bore of the fixed cylindrical member 34, to thereby restrain the shaft-shaped member 32 from moving further rearwards.

According to the fourth example, the force of moving the shaft-shaped member rearwards will not act on piston body 35, it is hence possible to prevent engaging portion 142 from deforming in a more improved way.

INDUSTRIAL APPLICABILITY

The present invention is preferably used for cosmetic products or medicine application products for applying cosmetic fluid or liquid medicine to a soft object such as skin, oral cavity etc. The invention is, in particular, preferable to be used for a liquid applicator that enables easy application of a high viscosity application liquid over a wide area of a soft applied object.

The invention claimed is:

1. A liquid applicator comprising:

a liquid pressing means for pressurizing an application liquid inside a main body so as to supply the application liquid to an applying member at the front end by the pressing of the liquid pressing means, and wherein the main body includes a front barrel portion on a tip thereof, and an application liquid storing space configured to store the application liquid is formed in the main body, and wherein the applying member is made of an elastic material selected from rubber, elastomer or closed-cell foam that is restorable and is formed with an everopening ejection opening and a communication path of a passage hole for communication between the inside and outside of the main body, and is formed with an applying portion that has a flat tapering shape with a tapered portion formed on both sides thereof, and the applying portion of the applying member is formed projected further forward from the ejection opening of the communication path, and the ejection opening opens in a flat direction of the applying portion on a slanted or a vertical surface raised on a rear end of the applying portion, and the applying portion is projected forward from the front barrel portion and is communicated with the application liquid storing space and the ejection opening, and wherein a thickness of a thinnest portion of a wall of the communication path is equal to a thickness of the applying portion or is less than the thickness of the applying portion, and wherein there is formed the communication path whose wall surface is flexible, and the communication path is enclosed by an elastic body selected among from rubber, elastomer or closed-cell foam that is restorable.

2. The liquid applicator according to claim 1, wherein the applying portion projected from the ejection opening constitutes a liquid retainer for temporarily retaining the application liquid or includes the liquid retainer.

3. The liquid applicator according to claim 1, further comprising a liquid depressurizing means for depressurizing the application liquid inside the main body, wherein after usage of the applying member the application liquid in the communication path is drawn back into the interior of the main body side by depressurizing the application liquid inside the main body using the depressurizing means.

4. A liquid applicator which includes an applying member at the front end of a tubular main body and is adapted to feed an application liquid to the applying member at the front end by pressurizing the application liquid stored in a storing space inside the main body by means of a liquid pressurizing/depressurizing mechanism attached to the main body and draw back the application liquid by depressurizing, wherein the liquid pressurizing/depressurizing mechanism includes a piston body that moves forwards and backwards relative to the storing space inside the main body to decrease and increase the volume of the storing space, and a driving mechanism that has a shaft-shaped member whose front part is engaged with the rear part of the piston body so as to allow the user to apply actuating force to drive the shaft-shaped member forwards and backwards to thereby move the piston body forwards and backwards;

an engaging portion having an interior space that opens rearwards is projectively formed to the rear in the rear of the piston body, and an insert hole that opens the interior space sidewards is formed on part of the side surface portion of the projected engaging portion in such a manner that, as to the distance between the opposing surfaces of the inner wall portion that defines the interior space, the distance on the front side is greater than the distance on the rear side by forming a stepped portion in between;

an engaging projected portion that is projected sidewards is formed in the front end part of the shaft-shaped member; and the front end part of the shaft-shaped member is positioned inside the interior space through the insert hole, so that the engaging projected portion is hooked on the stepped portion in the inner wall portion, whereby the front part of the shaft-shaped member is engaged with the engaging portion in the rear part of the piston body.

5. The liquid applicator according to claim 4, wherein the engaging portion in the rear part of the piston body is formed with the inner wall portion and stepped portion so that it assumes an approximately T-shaped configuration, and the engaging projected portion at the front end of the shaft-shaped member is formed in a flange shape whose width corresponds to the dimension of the interior space.

6. The liquid applicator according to claim 4, wherein a fixed cylindrical member in which a bore through which the shaft-shaped member is projected and retracted is formed at the end of the fixed cylindrical member closest to the storing space and piston body, is fixed to the main body, and an annular projection that is projected forwards around the bore is formed in the front end part of the fixed cylindrical member, the inside diameter of the annular projection, at least, at the front end being formed to be greater than the outside diameter of the rear end part of the engaging portion of the piston body.

7. The liquid applicator according to claim 6, wherein the inner peripheral surface of the annular projection in the front end part of the fixed cylindrical member and the outer peripheral surface of the rear end part of the engaging portion of the piston body are tapered reducing their diameter narrower toward the rear.

8. The liquid applicator according to claim 4, wherein a fixed cylindrical member in which a bore through which the shaft-shaped member is projected and retracted is formed at the end of the fixed cylindrical member closest to the storing space and piston body, is fixed to the main body, the shaft-shaped member has a large-diametric portion whose diameter is enlarged sideward, formed in the rear of the engaging projected portion that engages the engaging portion in the rear part of the piston body, and when the piston body is retracted, the large-diametric portion is adapted to abut the front end face around the bore of the fixed cylindrical member to thereby restrain the shaft-shaped member from moving further rearwards.

9. The liquid applicator according to claim 4, wherein the shaft-shaped member has recessed grooves and a male thread formed on the peripheral surface thereof along its axial direction, the driving mechanism includes: the shaft-shaped member; a fixed cylindrical member, fixed inside the main body by inserting the opening at the rear end of the main body, and having a female thread in the front end part thereof that mates the male thread on the outer peripheral surface of the shaft-shaped member; and an advancing member that has the shaft-shaped member passed through an irregular engaging bore having projections mating the grooves of the shaft-shaped member so as to be movable forwards and rearwards and unrotatable relative to the shaft-shaped member and is attached to the main body so as to be rotatable from the outside of the main body, and the piston body is moved forwards and rearwards through the shaft-shaped member by rotating the advancing member, to thereby increase and decrease the pressure on the application liquid inside the storing space.

10. The liquid applicator according to claim 9, wherein a cylindrical actuator through which the user performs rotational actuation is externally fitted in the rear part of the advancing member so as not to drop off, and either the inner periphery of the cylindrical actuator or the outer periphery in the rear part of the advancing member is formed with a groove while the other is formed with a projection that elastically engages the groove, and the engaging force between the groove and projection is set so that the engagement therebetween is disengaged when the rotational actuating force on the cylindrical actuator required to move the shaft-shaped member becomes equal to or greater than a fixed level.

11. The liquid applicator according to claim 5, wherein a fixed cylindrical member in which a bore through which the shaft-shaped member is projected and retracted is formed at the end of the fixed cylindrical member closest to the storing space and piston body, is fixed to the main body, and an annular projection that is projected forwards around the bore is formed in the front end part of the fixed cylindrical member, the inside diameter of the annular projection, at least, at the front end being formed to be greater than the outside diameter of the rear end part of the engaging portion of the piston body.

12. The liquid applicator according to claim 11, wherein the inner peripheral surface of the annular projection in the front end part of the fixed cylindrical member and the outer peripheral surface of the rear end part of the engaging portion of the piston body are tapered reducing their diameter narrower toward the rear.

13. The liquid applicator according to claim 5, wherein a fixed cylindrical member in which a bore through which the shaft-shaped member is projected and retracted is formed at the end of the fixed cylindrical member closest to the storing space and piston body, is fixed to the main body, the shaft-shaped member has a large-diametric portion whose diameter is enlarged sideward, formed in the rear of the engaging projected portion that engages the engaging portion in the rear part of the piston body, and when the piston body is retracted, the large-diametric portion is adapted to abut the front end face around the bore of the fixed cylindrical member to thereby restrain the shaft-shaped member from moving further rearwards.

14. A liquid applicator comprising:

a liquid pressing means for pressurizing an application liquid inside a main body so as to supply the application liquid to an applying member at the front end by the pressing of the liquid pressing means, wherein the applying member is made of an elastic material selected from rubber, elastomer or closed-cell foam that is restorable and is formed with an everopening ejection opening and a communication path of a passage hole for communication between the inside and outside of the main body, and wherein the main body includes a front barrel portion on a tip thereof, and an application liquid storing space configured to store the application liquid is formed in the main body, and an applying portion of the applying member is formed projected further forward from the ejection opening of the communication path with a comb portion, and the ejection opening opens in a flat direction of the applying portion on a slanted or a vertical surface raised on a rear end of the applying portion, and the applying portion is projected forward from the front barrel portion and is communicated with the application liquid storing space and the ejection opening, and wherein a thickness of a thinnest portion of a wall of the communication path is equal to a thickness of the applying portion or is less than the thickness of the applying portion, and wherein there is formed the communication path whose wall surface is flexible, and the communication path is enclosed by an elastic body selected among from rubber, elastomer or closed-cell foam that is restorable.

15. The liquid applicator according to claim 14, wherein the applying portion projected from the ejection opening constitutes a liquid retainer for temporarily retaining the application liquid or includes the liquid retainer.

16. The liquid applicator according to claim 14, further comprising a liquid depressurizing means for depressurizing the application liquid inside the main body, wherein after usage of the applying member the application liquid in the communication path is drawn back into the interior of the main body side by depressurizing the application liquid inside the main body using the depressurizing means.

17. A liquid applicator comprising:

a liquid pressing means for pressurizing an application liquid inside a main body so as to supply the application liquid to an applying member at the front end by the pressing of the liquid pressing means, wherein the applying member is made of an elastic material selected from rubber, elastomer or closed-cell foam that is restorable and is formed with an everopening ejection opening and a communication path of a passage hole for communication between the inside and outside of the main body, and wherein the main body includes a front barrel portion on a tip thereof, and an application liquid storing space configured to store the application liquid is formed in the main body, and an applying portion of the applying member is formed projected further forward from the ejection opening of the communication path and is formed in a knife-like form having an acute portion at its front end, and the ejection opening opens in a flat direction of the applying portion on a slanted or a vertical surface raised on a rear end of the applying portion, and the applying portion is projected forward from the front barrel portion and is communicated with the application liquid storing space and the ejection opening, and wherein a thickness of a thinnest portion of a wall of the communication path is equal to a thickness of the applying portion or is less than the thickness of the applying portion, and wherein there is formed the communication path whose wall surface is flexible, and the communication path is enclosed by an elastic body selected among from rubber, elastomer or closed-cell foam that is restorable.

18. The liquid applicator according to claim 17, wherein the applying portion projected from the ejection opening constitutes a liquid retainer for temporarily retaining the application liquid or includes the liquid retainer.

19. The liquid applicator according to claim 17, further comprising a liquid depressurizing means for depressurizing the application liquid inside the main body, wherein after usage of the applying member the application liquid in the communication path is drawn back into the interior of the main body side by depressurizing the application liquid inside the main body using the depressurizing means.

20. A liquid applicator comprising:

a liquid pressing means for pressurizing an application liquid inside a main body so as to supply the application liquid to an applying member at the front end by the pressing of the liquid pressing means, wherein the applying member is made of an elastic material selected from rubber, elastomer or closed-cell foam that is restorable and is formed with an everopening ejection opening and a communication path of a passage hole for communication between the inside and outside of the main body, and wherein the main body includes a front barrel portion on a tip thereof, and an application liquid storing space configured to store the application liquid is formed in the main body, and an applying portion of the applying member is formed projected further forward from the ejection opening of the communication path which is formed obliquely with respect to the axial direction of the applying member, and the ejection opening opens in a flat direction of the applying portion on a slanted or a vertical surface raised on a rear end of the applying portion, and the applying portion is projected forward from the front barrel portion and is communicated with the application liquid storing space and the ejection opening, and wherein a thickness of a thinnest portion of a wall of the communication path is equal to a thickness of the applying portion or is less than the thickness of the applying portion, and wherein there is formed the communication path whose wall surface is flexible, and the communication path is enclosed by an elastic body selected among from rubber, elastomer or closed-cell foam that is restorable.

21. The liquid applicator according to claim 20, wherein the applying portion projected from the ejection opening constitutes a liquid retainer for temporarily retaining the application liquid or includes the liquid retainer.

22. The liquid applicator according to claim 20, further comprising a liquid depressurizing means for depressurizing the application liquid inside the main body, wherein after usage of the applying member the application liquid in the communication path is drawn back into the interior of the main body side by depressurizing the application liquid inside the main body using the depressurizing means.

23. A liquid applicator comprising:

a liquid pressing means for pressurizing an application liquid inside a main body so as to supply the application liquid to an applying member at the front end by the pressing of the liquid pressing means, wherein the applying member is made of an elastic material selected from rubber, elastomer or closed-cell foam that is restorable and is formed with an everopening ejection opening and a communication path of a passage hole for communication between the inside and outside of the main body, and wherein the main body includes a front barrel portion on a tip thereof, and an application liquid storing space configured to store the application liquid is formed in the main body, and an applying portion of the applying member is formed projected further forward from the ejection opening of the communication path in a shape of forked claws, and the ejection opening opens in a flat direction of the applying portion on a slanted or a vertical surface raised on a rear end of the applying portion, and the applying portion is projected forward from the front barrel portion and is communicated with the application liquid storing space and the ejection opening, and wherein a thickness of a thinnest portion of a wall of the communication path is equal to a thickness of the applying portion or is less than the thickness of the applying portion, and wherein there is formed the communication path whose wall surface is flexible, and the communication path is enclosed by an elastic body selected among from rubber, elastomer or closed-cell foam that is restorable.

24. The liquid applicator according to claim 23, wherein the applying portion projected from the ejection opening constitutes a liquid retainer for temporarily retaining the application liquid or includes the liquid retainer.

25. The liquid applicator according to claim 23, further comprising a liquid depressurizing means for depressurizing the application liquid inside the main body, wherein after usage of the applying member the application liquid in the communication path is drawn back into the interior of the main body side by depressurizing the application liquid inside the main body using the depressurizing means.

26. A liquid applicator comprising:

a liquid pressing means for pressurizing an application liquid inside a main body so as to supply the application liquid to an applying member at the front end by the pressing of the liquid pressing means, wherein the applying member is made of an elastic material selected from rubber, elastomer or closed-cell foam that is restorable and is formed with a valve structure, an ejection portion which is opened by pressurization by the liquid pressing means while closed in a normal condition and a communication path of a passage hole for communication between the inside and outside of the main body, and is formed with an applying portion that has a flat tapering shape with a tapered portion formed on both sides thereof, and wherein the main body includes a front barrel portion on a tip thereof, and an application liquid storing space configured to store the application liquid is formed in the main body, and the applying portion of the applying member is formed projected further forward from the valve structure of the communication path, and the valve structure opens in a flat direction of the applying portion on a slanted or a vertical surface raised in a rear end of the applying portion, and the applying portion is projected forward from the front barrel portion and is communicated with the application liquid storing space and the ejection opening, and wherein a thickness of a thinnest portion of a wall of the communication path is equal to a thickness of the applying portion or is less than the thickness of the applying portion, and wherein there is formed the communication path whose wall surface is flexible, and the communication path is enclosed by an elastic body selected among from rubber, elastomer or closed-cell foam that is restorable.

27. The liquid applicator according to claim 26, wherein the applying portion projected from the ejection opening constitutes a liquid retainer for temporarily retaining the application liquid or includes the liquid retainer.

28. The liquid applicator according to claim 26, further comprising a liquid depressurizing means for depressurizing the application liquid inside the main body, wherein after usage of the applying member the application liquid in the communication path is drawn back into the interior of the main body side by depressurizing the application liquid inside the main body using the depressurizing means.

* * * * *